US012145701B2

(12) United States Patent
Lynn et al.

(10) Patent No.: US 12,145,701 B2
(45) **Date of Patent: *Nov. 19, 2024**

(54) VEHICLE FOR INSTALLING ANCHORS IN AN UNDERWATER SUBSTRATE

(71) Applicant: Other Lab, LLC, San Francisco, CA (US)

(72) Inventors: Peter Sturt Lynn, Alameda, CA (US); Jonathan B. Pompa, Long Beach, CA (US)

(73) Assignee: OTHER LAB, LLC, San Francisco, CA (US)

( * ) Notice: Subject to any disclaimer, the term of this patent is extended or adjusted under 35 U.S.C. 154(b) by 36 days.

This patent is subject to a terminal disclaimer.

(21) Appl. No.: 18/080,491

(22) Filed: Dec. 13, 2022

(65) Prior Publication Data

US 2023/0116361 A1 Apr. 13, 2023

Related U.S. Application Data

(63) Continuation of application No. 17/159,632, filed on Jan. 27, 2021, now Pat. No. 11,565,779.

(60) Provisional application No. 62/966,187, filed on Jan. 27, 2020.

(51) Int. Cl.

| | |
|---|---|
| ***E02D 7/22*** | (2006.01) |
| ***B63B 21/20*** | (2006.01) |
| ***B63B 21/26*** | (2006.01) |
| ***B63B 79/10*** | (2020.01) |
| ***B63B 79/40*** | (2020.01) |

(Continued)

(52) U.S. Cl.

CPC ..... *B63B 79/40* (2020.01); *B63B 21/20* (2013.01); *B63B 21/26* (2013.01); *B63B 79/10* (2020.01); *B63H 11/00* (2013.01); *E02D 5/801* (2013.01); *E02D 7/22* (2013.01)

(58) Field of Classification Search

CPC .. E02D 5/801; E02D 5/56; E02D 7/22; E02D 7/26; E04H 12/2223; E21B 7/122; E21B 7/132; E21B 7/136; B63B 79/10; B63B 21/20; B63B 21/26; B63H 11/00

See application file for complete search history.

(56) References Cited

U.S. PATENT DOCUMENTS

| | | | |
|---|---|---|---|
| 3,741,320 | A | 6/1973 | Hilfing |
| 3,841,105 | A | 10/1974 | Cannon |
| 3,851,492 | A | 12/1974 | Cannon et al. |

(Continued)

FOREIGN PATENT DOCUMENTS

| | | | |
|---|---|---|---|
| JP | S6132284 | A | 2/1986 |
| KR | 101233032 | B1 | 2/2013 |

(Continued)

OTHER PUBLICATIONS

European Patent Office Search Report dated Feb. 27, 2024, Application No. 21747002.0, 9 pages.

(Continued)

*Primary Examiner* — Benjamin F Fiorello

(74) *Attorney, Agent, or Firm* — Davis Wright Tremaine LLP

(57) ABSTRACT

An anchor installation vehicle that includes a vehicle frame having a top end and bottom end, one or more rotational thrusters, and an anchor system configured to hold an anchor extending from the bottom end of the vehicle frame.

17 Claims, 18 Drawing Sheets

(51) Int. Cl.
*B63H 11/00* (2006.01)
*E02D 5/80* (2006.01)

(56) References Cited

U.S. PATENT DOCUMENTS

| | | | | |
|---|---|---|---|---|
| 4,033,281 | A | 7/1977 | Lundh | |
| 6,066,015 | A | 5/2000 | Brown | |
| 6,223,671 | B1 | 5/2001 | Head | |
| 6,273,645 | B1 | 8/2001 | Hamre | |
| 7,380,614 | B1 | 6/2008 | Williamson et al. | |
| 7,703,534 | B2 | 4/2010 | Sheshtawy | |
| 8,684,629 | B2 | 4/2014 | Asplund et al. | |
| 9,605,400 | B2 | 3/2017 | Fraenkel et al. | |
| 2004/0258486 | A1* | 12/2004 | Otsuka | E02D 3/10 405/231 |
| 2006/0118309 | A1 | 6/2006 | Head | |
| 2009/0220308 | A1* | 9/2009 | Fraenkel | E02B 17/0845 405/227 |
| 2013/0058727 | A1* | 3/2013 | Asplund | E02D 27/52 405/224 |
| 2016/0348332 | A1 | 12/2016 | Talbert et al. | |
| 2016/0362864 | A1 | 12/2016 | Thurner et al. | |

FOREIGN PATENT DOCUMENTS

| | | | |
|---|---|---|---|
| NL | 1009277 | C2 | 11/1999 |
| RU | 2594270 | C1 | 8/2016 |
| SU | 1466981 | A1 | 3/1989 |
| WO | 9846833 | A1 | 10/1998 |
| WO | 2012059760 | A1 | 5/2012 |

OTHER PUBLICATIONS

International Preliminary Report on Patentability mailed Aug. 11, 2022, Patent Application No. PCT/US2021/015228, 7 pages.
International Search Report and Written Opinion mailed Apr. 23, 2021, Patent Application No. PCT/US2021/015228, 9 pages.

* cited by examiner

VEHICLE FOR INSTALLING ANCHORS IN AN UNDERWATER SUBSTRATE

CROSS-REFERENCE TO RELATED APPLICATION

This application is a continuation of U.S. application Ser. No. 17/159,632, filed Jan. 27, 2021, entitled "VEHICLE FOR INSTALLING ANCHORS IN AN UNDERWATER SUBSTRATE," which is a non-provisional of and claims the benefit of U.S. Provisional Application No. 62/966,187, filed Jan. 27, 2020, entitled "REMOTELY OPERATED UNDERWATER VEHICLE FOR INSTALLING SEABED ANCHORS". These applications are hereby incorporated herein by reference in their entirety and for all purposes.

STATEMENT REGARDING FEDERALLY-SPONSORED RESEARCH

This invention was made with Government support under contract number DE-AR0000923 awarded by DOE, Advanced Research Projects Agency-Energy. The Government has certain rights in this invention.

BACKGROUND

Many methods exist for anchoring objects to a substrate under water such as a seabed. For various reasons, including minimizing environmental impact, minimizing structural disturbance of an anchoring substrate, mass reduction, cost savings, and management of installation noise, helical anchors have become a preferred method of anchoring. Installation of helical anchors typically requires application of torque to the anchor to embed it into the substrate. Hardware to accomplish the rotary installation by application of torque currently requires support of one or more surface vessels which often need to be very large.

Existing anchor types include, but are not limited to, drag embedment, pile, suction caisson, gravity, and helical or screw anchors. Drag embedment anchors are relatively cost effective and capable of scaling to high loads, but installation substantially disturbs the seabed, requires high thrust, and such anchors are directional. Piles are much heavier and more expensive and can sustain multi-directional pull. They are typically hammered into place, which is very noisy to marine life, and they typically cannot be installed at significant depth. Suction caissons are similar to piles, but are generally larger in diameter and they are installed using suction, which can be much quieter and can be suitable for greater depths. Gravity anchors generally consist of a very large steel and concrete weight and such an anchor can quickly become problematic to install at larger scales. Gravity anchors are also prone to being dragged. Helical anchors are related to drag embedment anchors and piles and they can be physically screwed into the seabed with high precision and little disturbance of the surrounding seabed. They can be lightweight and highly cost effective, but they currently depend on a submerged hydraulic drilling rig which is lowered from a boat to install them. The torque reaction of the hydraulic motor must be countered, which often entails further seabed disturbance.

In view of the foregoing, a need exists for an improved helical anchor installation system and method for embedding helical anchors in a substrate under water in an effort to overcome the aforementioned obstacles and deficiencies of conventional anchor installation systems.

Figure 1:
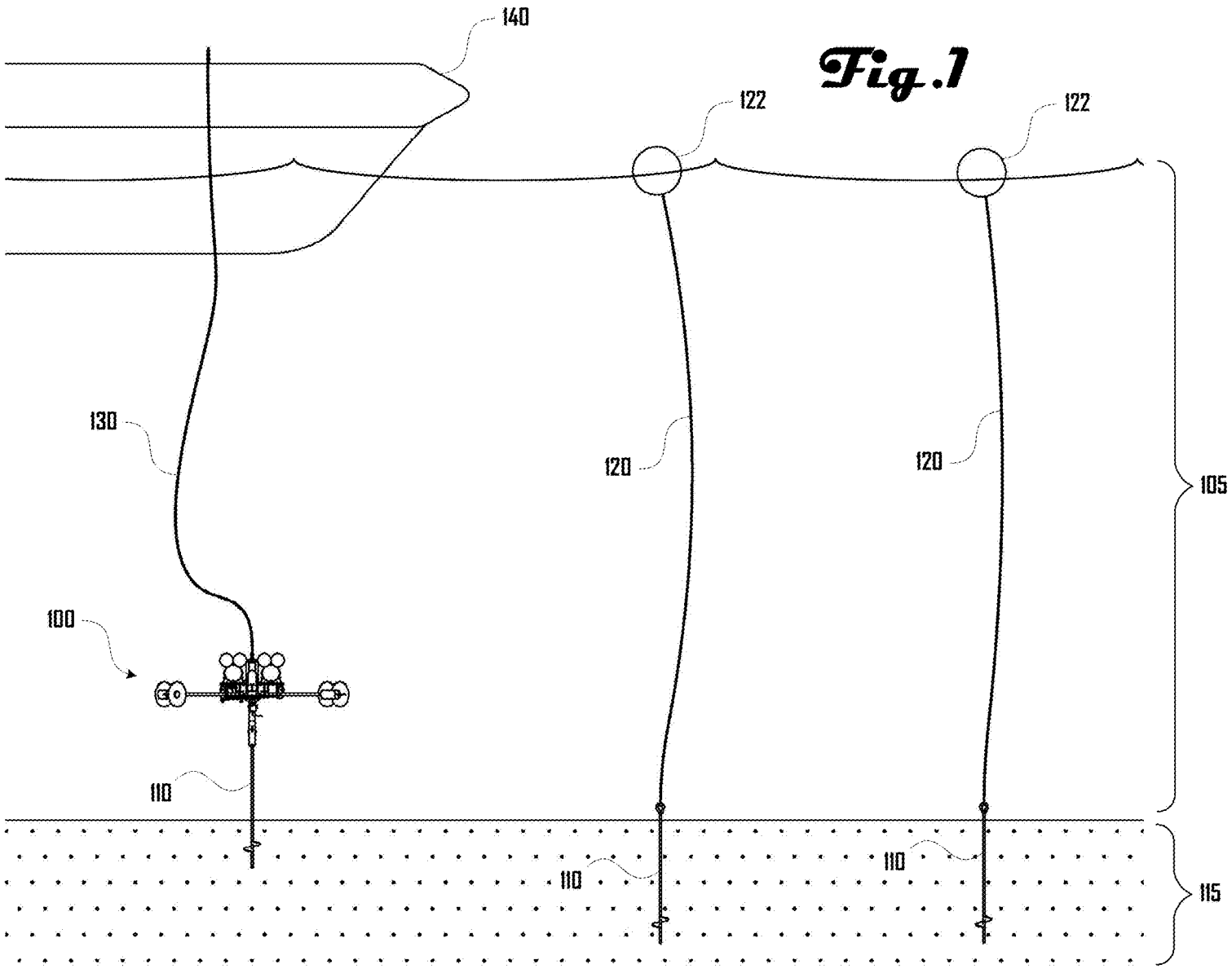
FIG. 1 is an example illustration of a vehicle installing a plurality of anchors in an underwater substrate in accordance with one embodiment.

It should be noted that the figures are not drawn to scale and that elements of similar structures or functions are generally represented by like reference numerals for illustrative purposes throughout the figures. It also should be noted that the figures are only intended to facilitate the description of the preferred embodiments. The figures do not illustrate every aspect of the described embodiments and do not limit the scope of the present disclosure.

DETAILED DESCRIPTION

Various embodiments discussed herein, including the example shown in FIG. 1, relate to a vehicle 100 that is configured to maneuver in a body of water 105 and install anchors 110 in an underwater substrate 115 such as a seabed. As shown in one example of FIG. 1, a plurality of anchors 110 can be installed in the substrate 115 with a line 120 extending from the anchor 110 to a float 122 on the surface of the water 105; however, anchors 110 can be used in a multitude of other ways as discussed in more detail herein. The vehicle 100 in some embodiments can comprise an operation tether 130 that extends to and is operably coupled to a support vessel 140, such a boat, ship, or the like.

While various example embodiments discussed herein relate to installing anchors 110 in the ocean and a seabed, further examples can be related to any suitable body of water 105 and substrate 115 within the body of water 105. For example, various embodiments can be employed in natural or man-made bodies of water 105 such as an ocean, river, lake, creek, pond, stream, tank, pool, or the like. Additionally, vehicles 100 can be configured to operate at various suitable depths including in shallow to deep-sea environments.

Also, while various embodiments relate to substrate 115 that is at the bottom of a body of water 105 such as a seabed, further embodiments can relate to installing anchors 110 in various suitable natural or man-made substrates 115, which can be at various angles or orientations. For example, anchors 110 can be in a seabed of various angles with the anchors 110 being oriented perpendicular to the plane of the substrate or other suitable angle such as parallel to gravity and the like. Such a seabed substrate 115 can comprise various types of material such as sand, silt, dirt, gravel, rocks and/or sold rock and the like. Accordingly, various embodiments can be configured for use with soft substrates 115 such as silt, hard substrates such as solid rock, or a combination thereof. Also, embodiments can be configured to install anchors in materials such as wood, concrete, polymers, metal, ice or the like, which in some examples can be part of underwater structures such as a concrete slab, sunken ship, floating ship, wooden piling, retaining wall, underwater building, dam, iceberg, or the like. Accordingly, some examples can be configured to install anchors in vertical or inverted substrates, or other suitable angle such as the hull of a floating ship or iceberg. Additionally, some embodiments can be related to aerial vehicles 100 configured to install anchors 110.

As shown in the example of FIG. 1, some embodiments include a vehicle 100 with a tether 130 that extends to a support vessel 140 such as a ship and the tether 130 provides for communication between the vehicle 100 and support vessel 140, a power supply to the vehicle 100, a fluid supply to the vehicle 100, a physical tether to the vehicle 100, and the like. For example, in some embodiments, operators on a support vessel 140 can control the vehicle 100 to install one or more anchors 110 in a substrate, which can include providing control data to the vehicle 100 via the tether 130; receiving data from the vehicle 100 (e.g., video, sensor data, position data, vehicle state data, the like); providing fluid to the vehicle 100 (e.g., to fill a ballast tank or float to change buoyancy of the vehicle 100); physically moving, pulling or towing the vehicle 100, or the like. However, in some embodiments, one or more of such functions can be absent and/or a tether 130 can be completely absent. For example, some embodiments can include an autonomous or semi-autonomous vehicle 100, which can operate without or with limited control signals and without external power such that a tether 130 may not be necessary.

Additionally, some embodiments can include wireless communication with the vehicle 100 such that a wired connection to the vehicle 100 can be absent. For example, some embodiments can communicate wirelessly through the air with the vehicle 100 when the vehicle or a vehicle antenna surfaces or a vehicle 100 can comprise a wireless antenna that floats on the water 105 with a wired connection to the vehicle 100 below the water 105. Some embodiments can include underwater wireless communication. Also, while some embodiments include a ship, boat or other vessel as a support vessel 140, in some embodiments, a support vessel 140 can include systems based on land, aquatic structures such as a drilling platform, an aerial vehicle, or the like.

Also, while the example of FIG. 1 illustrates a plurality of anchors 110 being installed in a substrate 105 with a line 120 extending from the anchor 110 to a float 122 on the surface of the water 105, in further embodiments, one or more anchors 110 of various suitable sizes can be installed with or without various suitable hardware for various suitable uses. For example, in some embodiments, one or more anchors 110 can be used in docks, seawalls, wave energy systems, wind turbines, anchoring a vessel such as a ship, aquaculture, boat mooring, buoy anchoring, oil and gas, pipeline anchoring, scientific instrument anchoring, geo-tech core drilling, wells, tunnels, oceanic surveying, geo testing and the like.

Figure 8:
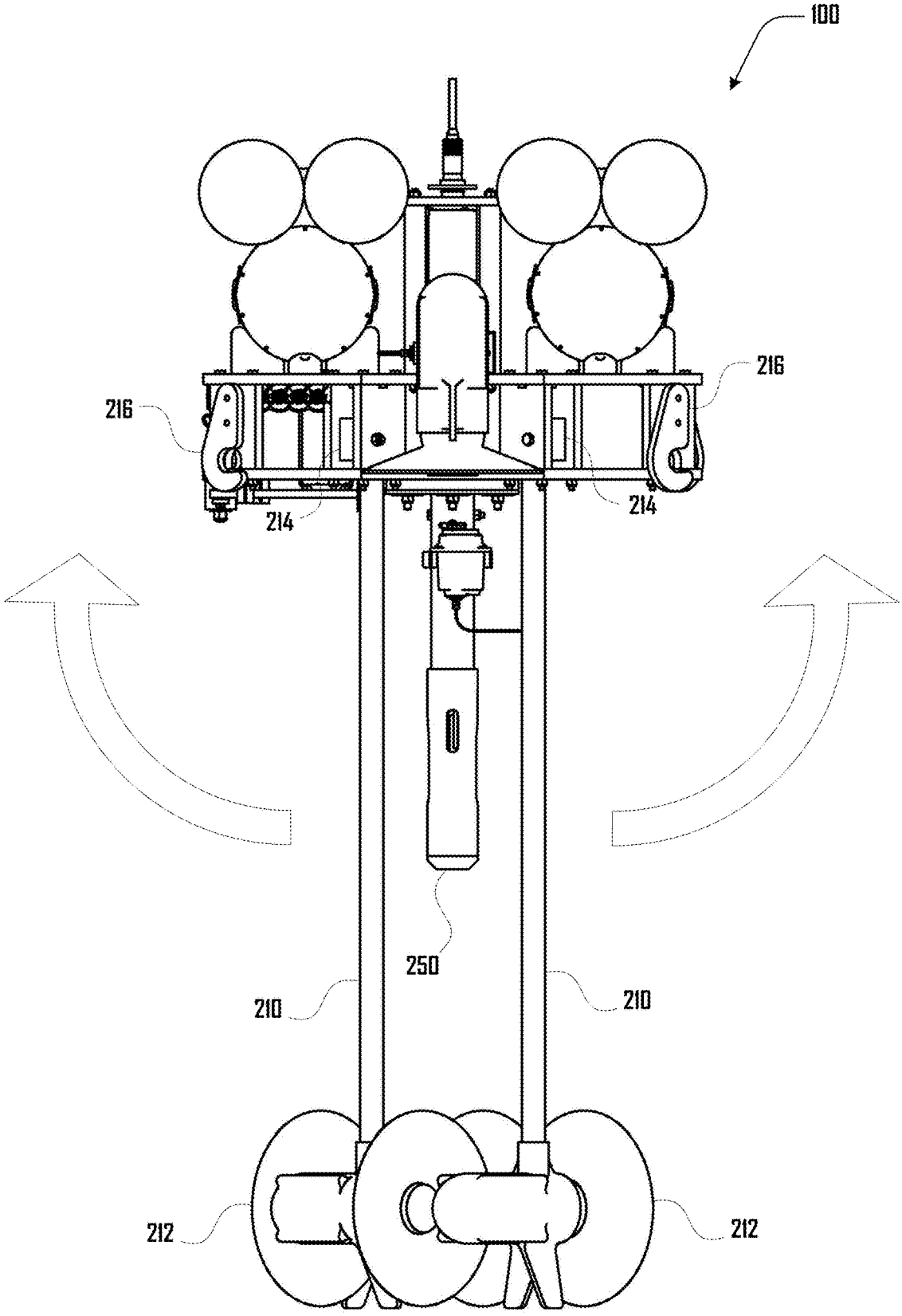
FIG. 8 is a side view of the vehicle of FIGS. 2-7 with the arms of the vehicle in a folded configuration.

Turning to FIGS. 2-8, one example embodiment of a vehicle 100 is illustrated that comprises a vehicle frame 205 with four arms 210 extending therefrom with rotational thrusters 212 disposed at respective distal ends of the arms 210. The arms 210 can be rotatably coupled to the vehicle frame 205 via an arm joint 214 and the arms 210 can be locked in place via respective arm locks 216. For example, FIG. 8 illustrates a configuration of the vehicle 100 where the arms 210 are disposed parallel to a central axis Y of the vehicle 100 and can be rotated upward via the arm joints 214 to a configuration as shown in FIGS. 2-8, where the arms 210 extend perpendicular to the central axis Y in a common plane and are locked in place via the arm locks 216. While an example of an arm lock 216 being positioned on the frame is shown in the example of FIGS. 2-8, further embodiments can include arm locks 216 disposed on the arm 210, such as a hook, or the like.

In various embodiments, it can be desirable for the arms 210 to be collapsible to the configuration of FIG. 8 for easier transportation of the vehicle 100. In some embodiments, thrusters 212 and/or other elements can be readily detached from the vehicle 100 for transport, and in some cases, the vehicle 100 and any elements thereof can be packed for air transport, which can be desirable for installation lead times in various examples.

Additionally, in some embodiments, it can be desirable for the arms 210 to be actuated to different positions instead of being locked at a specific angle such as 90° from the central axis Y. For example, in some embodiments, the vehicle 100 can be configured to move the arms 210 greater than and/or less than 90° from the central axis Y. Moving the arms 210 upward and/or downward can be desirable to avoid an arm 210 or thruster(s) 212 from hitting a substrate or other object during anchor installation, to change torque or rotation, to generate upward or downward force, and the like. In some examples, the arms 212 can be limited to movement in unison; can be actuated individually to different separate angles; can be actuated in sets, and the like.

Additionally, in some embodiments, the length of the arms 210 can be changed. For example, the arms 210 can be telescoping, configured to move in and out of the frame 205, and the like. Changing the length of the arms 210 can be desirable to avoid an arm 210 or thruster(s) 212 from hitting a substrate or other object during anchor installation, to change torque or rotation, and the like.

While the example of FIGS. 3 and 5-8, 12 illustrates a vehicle 100 with a preferred embodiment of four arms 210, further embodiments can have any suitable number of arms 210, including 1, 2, 3, 4, 5, 6, 7, 8, 9, 10, 12, 14, 16, 18, 24, 36, 48, 56, 72 and the like. Additionally, in some embodiments, arms 210 can be absent from the vehicle 100; for example, a vehicle 100 with one or more central thrusters that are not disposed on arms 210.

The vehicle can comprise one or more flotation tanks 220, electronic system 230, vertical thrusters 240 and an anchor system 250. A tether 130 can be coupled to the frame 205 in some embodiments via a slip ring tether attachment 260 at a top end and aligned with the central axis Y.

In some examples, winches for the tether 130 can incorporate a slip ring to allow spooling of the tether 130 out from the support vessel. Additionally, the tether 130 may incorporate a slip ring near or on the vehicle 100 to allow rotation of the vehicle 100 without introducing twist to the support tether while the vehicle 100 rotates to install an anchor 110. The slip ring may be designed to rotate with very little torque such that the rotational stiffness of the tether 130 is sufficient to cause rotation. The slip ring may be constructed to carry an axial load sufficient to match the tensile capacity of the tether 130. In some embodiments, a slip ring may not be used, with the tether being allowed to twist a limited number of times during helical anchor installation, being untwisted and even counter twisted between installations.

In some examples, the tether 130 may incorporate a feature that serves to increase the rotational drag of the tether 130 in water 105. Such a feature can reduce the tendency of the portion of a tether 130 above a slip ring from rotating with the portion below a slip ring. This feature, in some examples, may take the form of a set of radial paddles or arms attached to the tether 130.

A tether and/or slip ring may be attached to the 130 in such a way that tension applied to the tether 130 or to a secondary tension member can be passed directly through the frame of the vehicle 100 to an anchor 110 and/or the device holding the anchor 110 (e.g., anchor system 250). This can allow testing of anchor embedment strength and removal of anchors by direct tension from a support surface vessel 140, via the tether 130.

Figure 11:
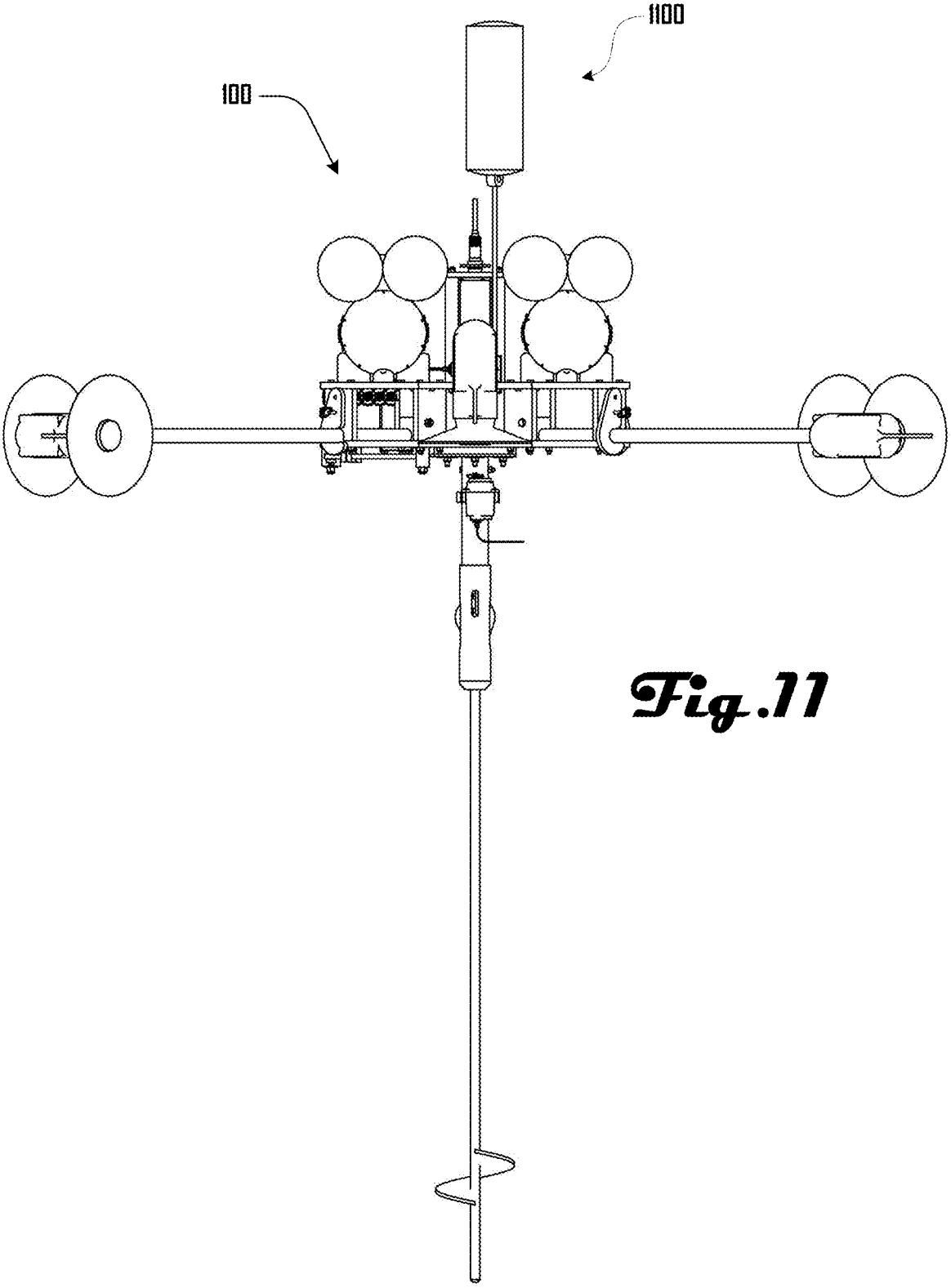
FIG. 11 is a side view of a vehicle of one embodiment comprising a vehicle float.

The flotation tanks 220 can be configured to hold fluid (e.g., liquid and/or gas), which can be configured to change the buoyancy of the vehicle 100. For example, changing the buoyancy of the vehicle 100 can be desirable to allow the vehicle 100 to sink from the surface of water 105 to a location where an anchor 110 will be installed; to float to the surface of the water 105 to be collected, re-supplied, receive instruction, or the like; to provide for maneuverability in the water; to apply additional downward force on an anchor 110 being installed, and the like. Additionally, as shown in the example of FIG. 11, some embodiments can comprise one or more vehicle float 1100, which can be detachable from the vehicle via a float release 222. Changing the buoyancy of the vehicle 100 in various embodiments can include, foam elements, introducing and/or removing various fluids from the flotation tanks 220 and/or vehicle float 1100, such as water, air, carbon dioxide, helium, nitrogen, or the like.

The electronic systems 230 and comprise or be associated with various sensors and/or imaging devices including a torque sensor 232, top camera 234 and bottom camera 236 (see FIGS. 6 and 7), inertial measurement unit, Doppler velocity log (DVL), magnetometer, imaging sonar, level sensor, water pressure sensor, thermometer, LIDAR, global positioning system (GPS), and the like. Further embodiments and functionalities of the electronic systems are discussed in more detail herein.

Figure 2:
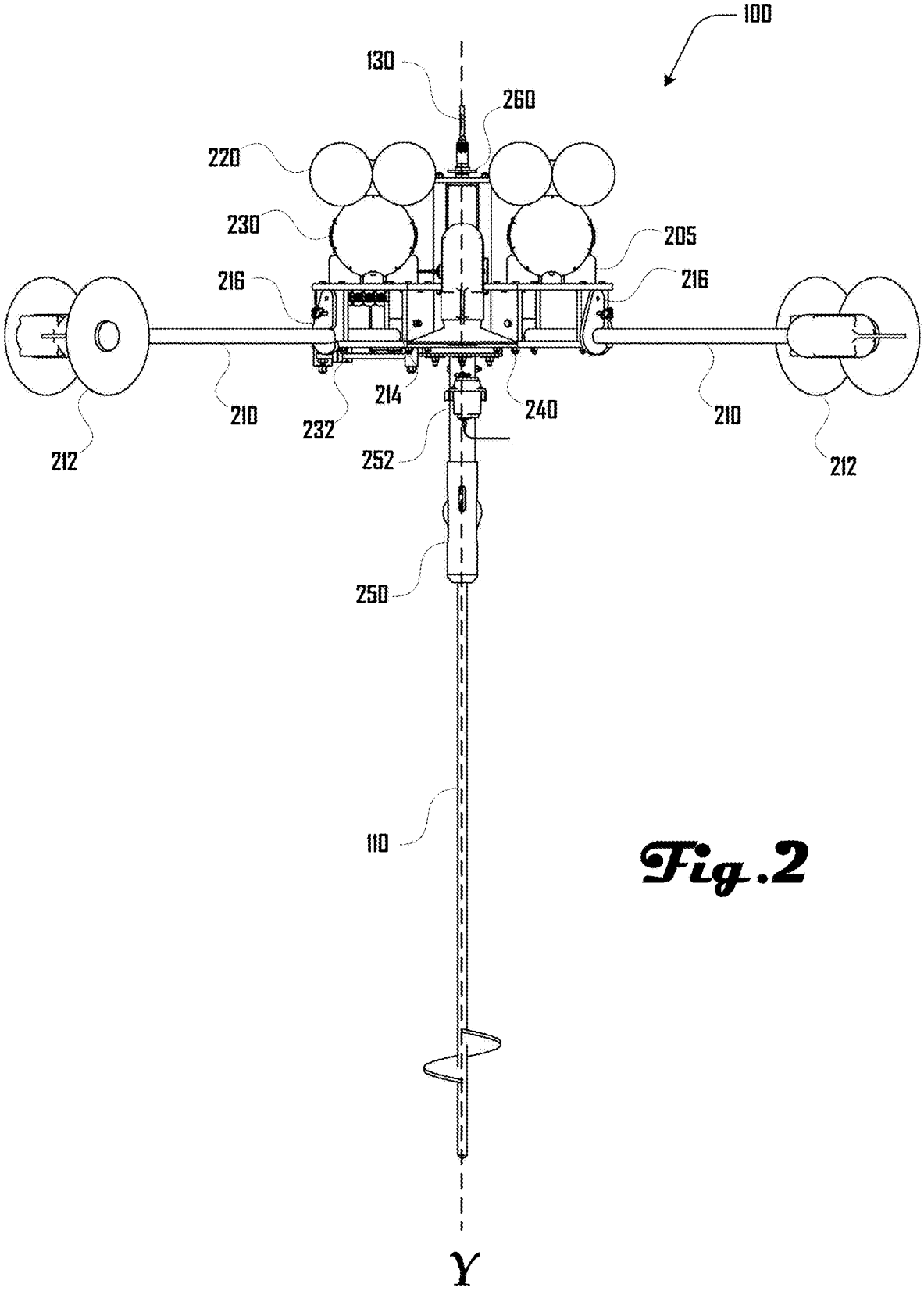
FIG. 2 is a side view of a vehicle in accordance with another embodiment.
Figure 3:
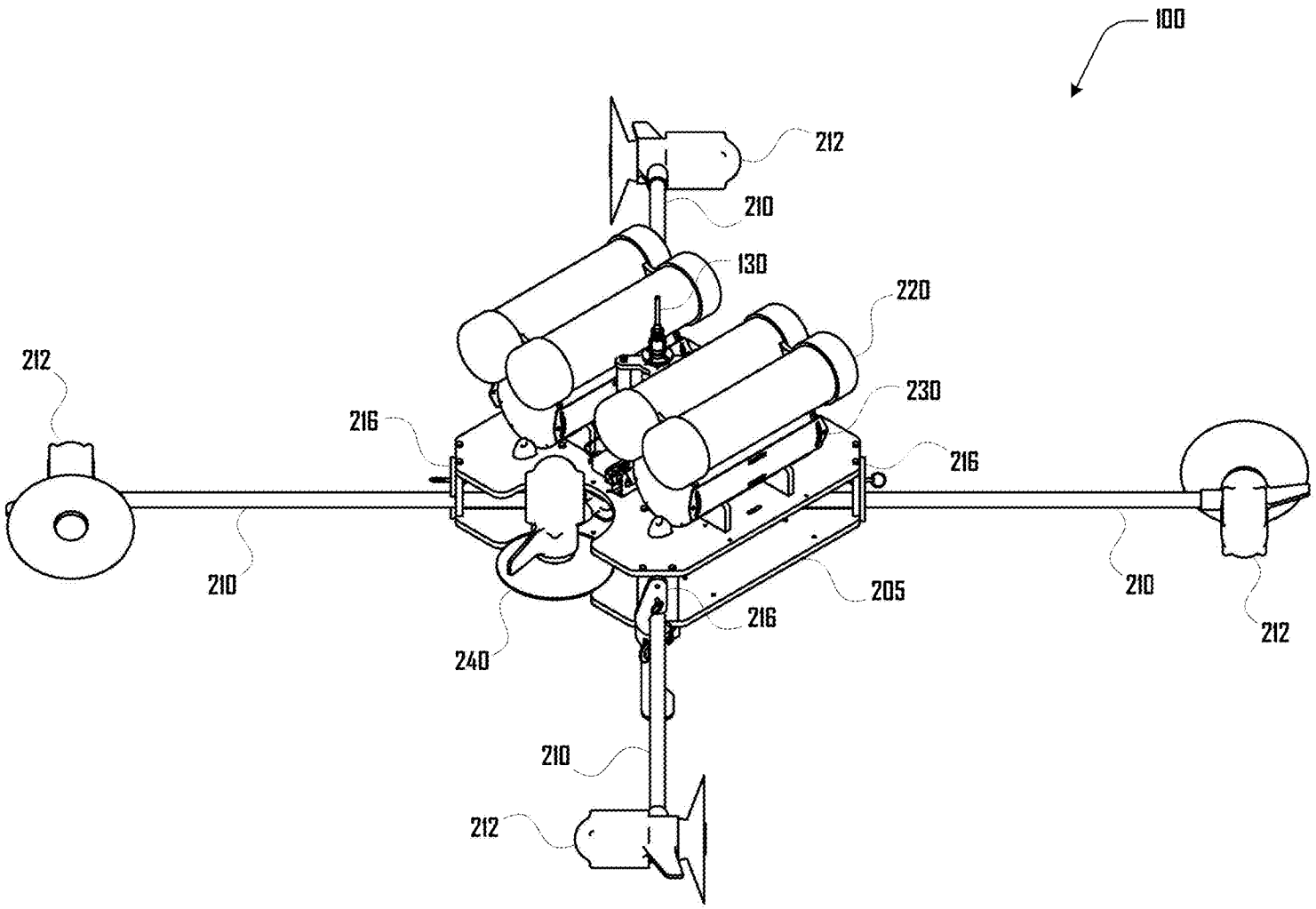
FIG. 3 is a perspective view of the vehicle of FIG. 2.
Figure 4:
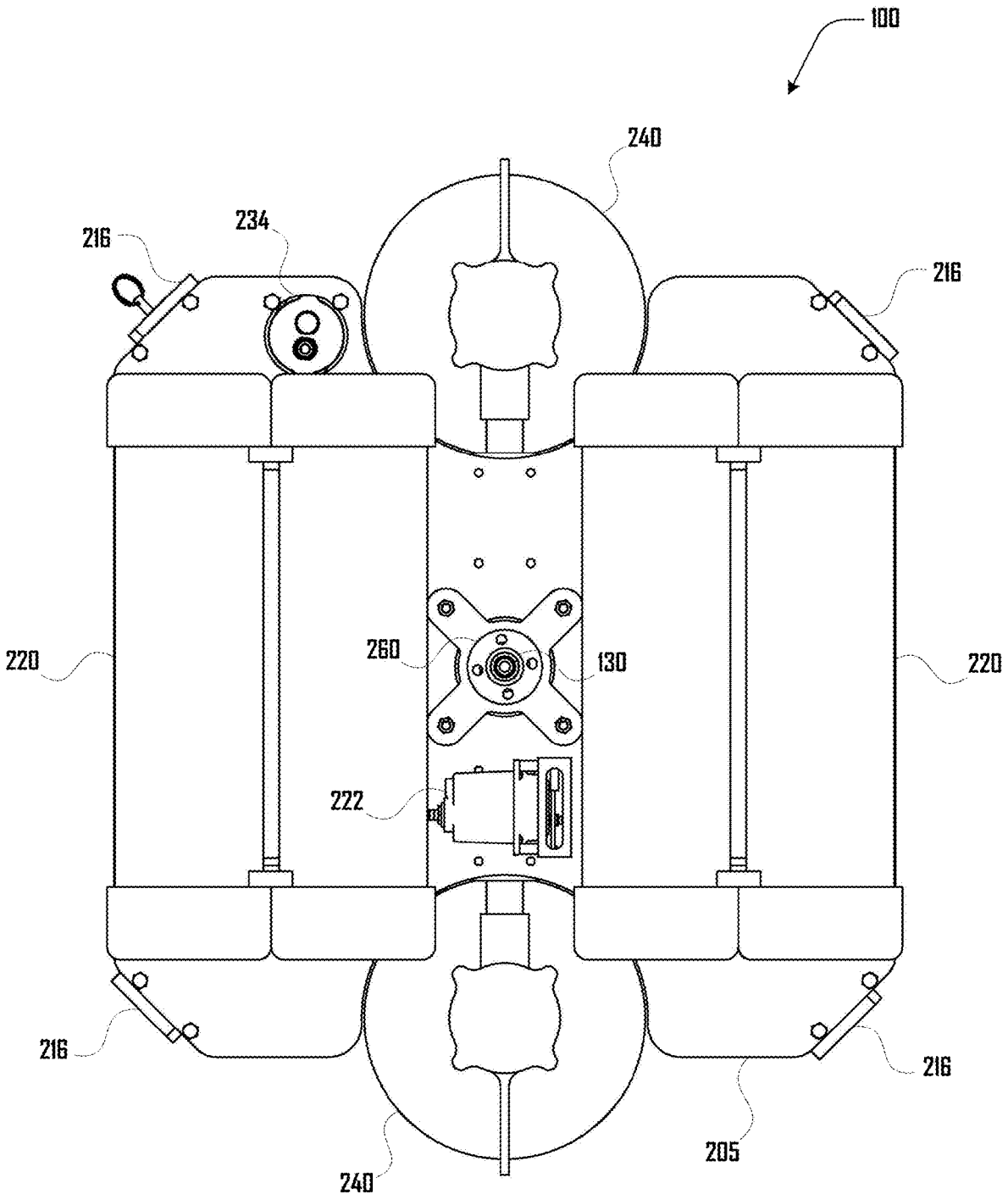
FIG. 4 is a top view of a portion of the vehicle of FIGS. 2 and 3.
Figure 5:
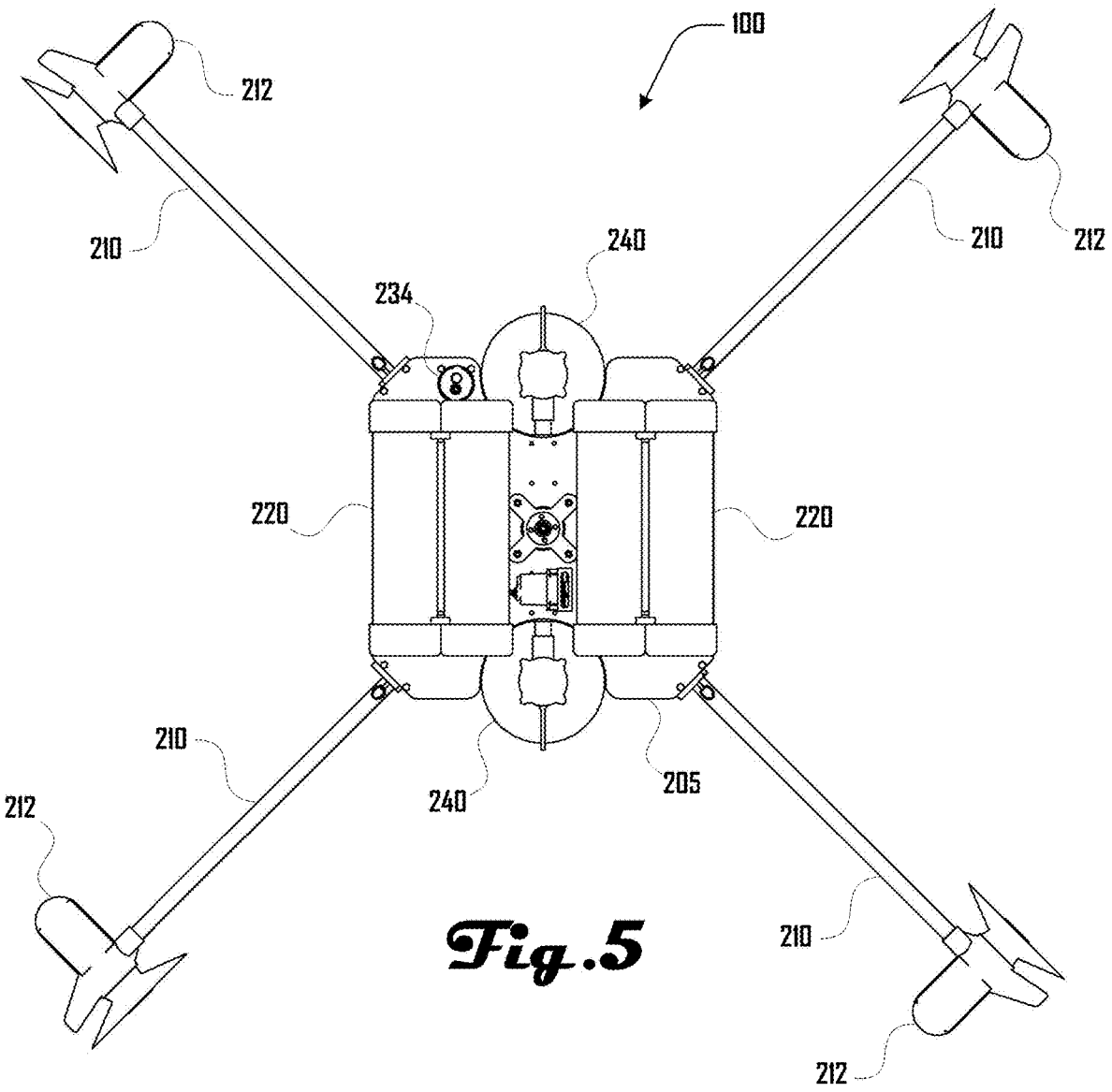
FIG. 5 is another top view of the vehicle of FIGS. 2-4.
Figure 6:
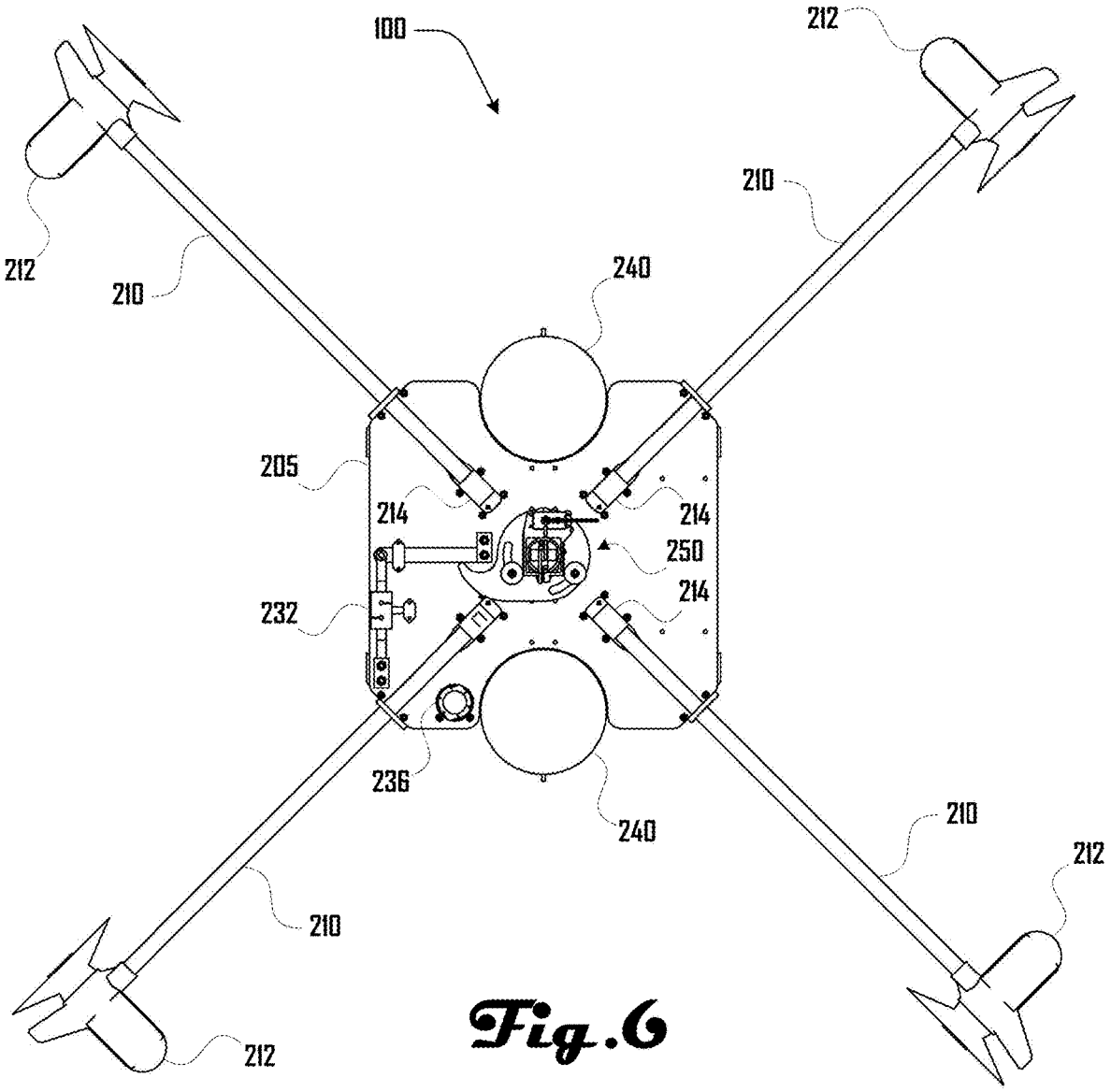
FIG. 6 is a bottom view of the vehicle of FIGS. 2-5.
Figure 7:
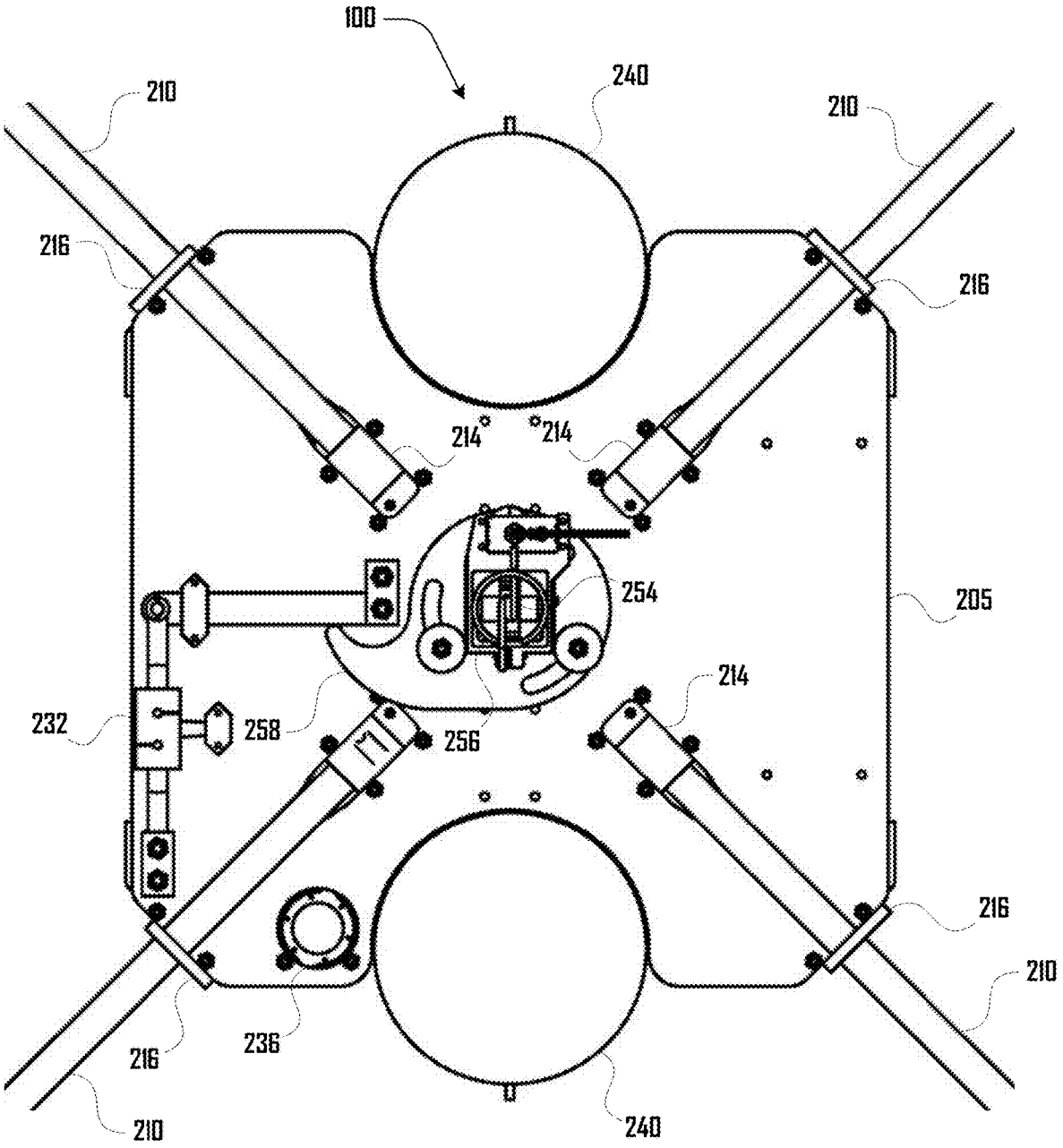
FIG. 7 is a close-up bottom view of the vehicle of FIGS. 2-6.

As shown in FIGS. 4-7, in various embodiments, the vehicle 100 can comprise a pair of vertical thrusters 240 on opposing sides of the frame 205 with the vertical thrusters 240 aligned parallel to the central axis Y and pointing downward toward the anchor 110 and anchor system 250 as shown in FIG. 2. In further embodiments, there can be any suitable plurality of vertical thrusters 240, a single vertical thruster 240, or a vertical thruster 240 can be absent. Additionally, in various examples one or more vertical thruster 240 can be oriented or orientable in various suitable directions.

Figure 10A:
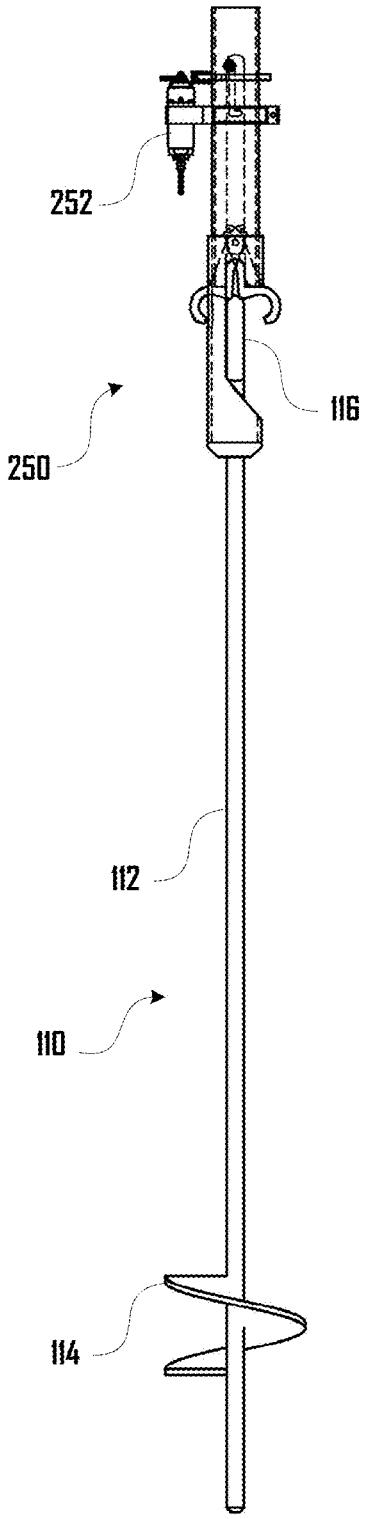
FIG. 10*a* is a side view of an anchor system in accordance with an embodiment.
Figure 10B:
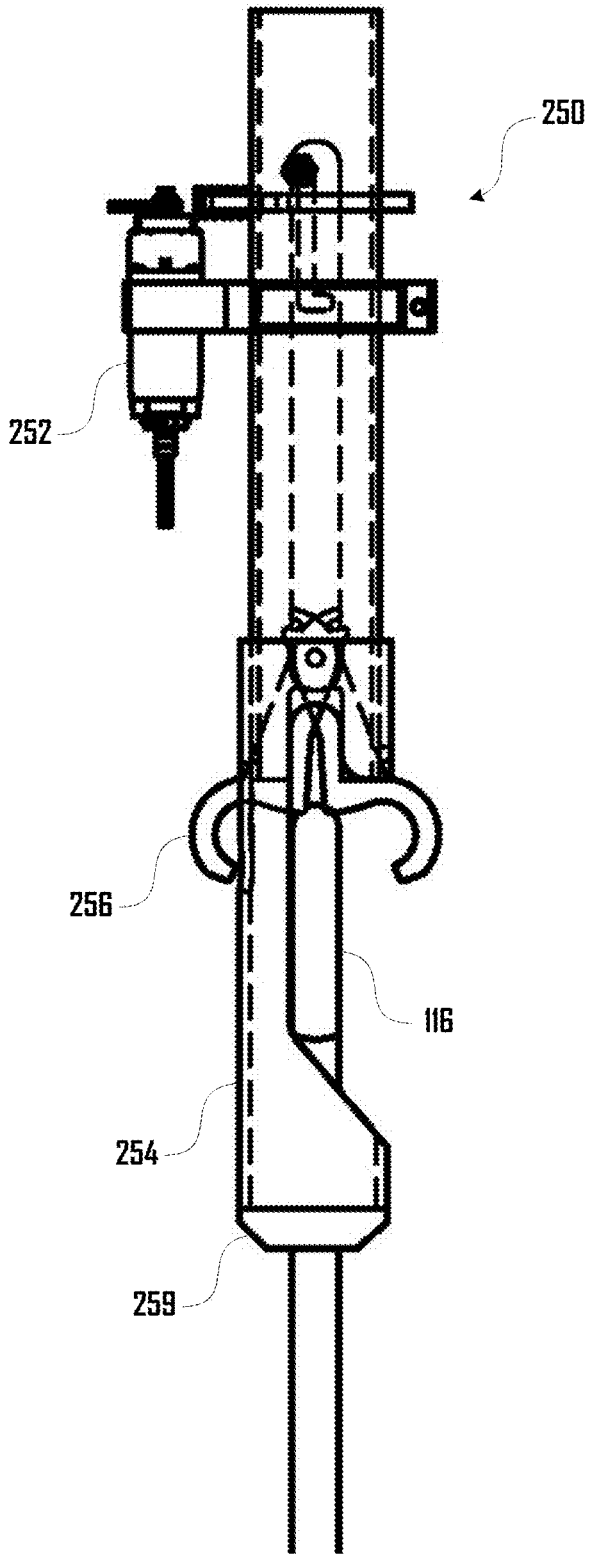
FIG. 10*b* is a close-up side view of the anchor system of FIG. 10*a*.

The anchor system 250 can include an anchor servo 252 configured to grasp and/or release an anchor 110, a torque tube 254, an anchor attachment claw 256, and a rotational compliance plate 258 that can be used for torque spiking as discussed herein. For example, FIGS. 10*a* and 10*b* illustrate close-up views of anchor system 250 where a shaft 112 and eye 116 of an anchor 110 can be held by the anchor system 250 via an anchor guide 259 of the torque tube 254, with the attachment claw 256 being configured to grasp and release the eye 116 of the anchor 110 via actuation of the anchor servo 252.

For example, in various embodiments, an anchor 110 can be coupled with the vehicle 100 (e.g., via an attachment claw 256 grasping the eye 116 of an anchor 110 via actuation of the anchor servo 252); the vehicle 100 can take the anchor 110 to a location on a substrate 115 at the bottom of a body of water 105 and install the anchor 110; the vehicle and release the installed anchor 110 (e.g., via an attachment claw 256 releasing the eye 116 of an anchor 110 via actuation of the anchor servo 252); and the vehicle 100 can then obtain another anchor 110 which can be transported to another installation location in the substrate 115 at the bottom of the body of water 105. As discussed herein, the vehicle 100 can be configured to rotatably install an anchor 110 and the vehicle can similarly be configured to rotatably uninstall or remove an anchor 110.

While the example of an attachment claw 256 grasping and releasing an eye 116 of an anchor 110 is shown in various examples herein, it should be clear that various suitable mechanisms for coupling an anchor 110 with a vehicle 100 can be present in further embodiments, such as a collet, dog connection, magnetic lock, nested polygonal shafts, or the like.

Figure 9:
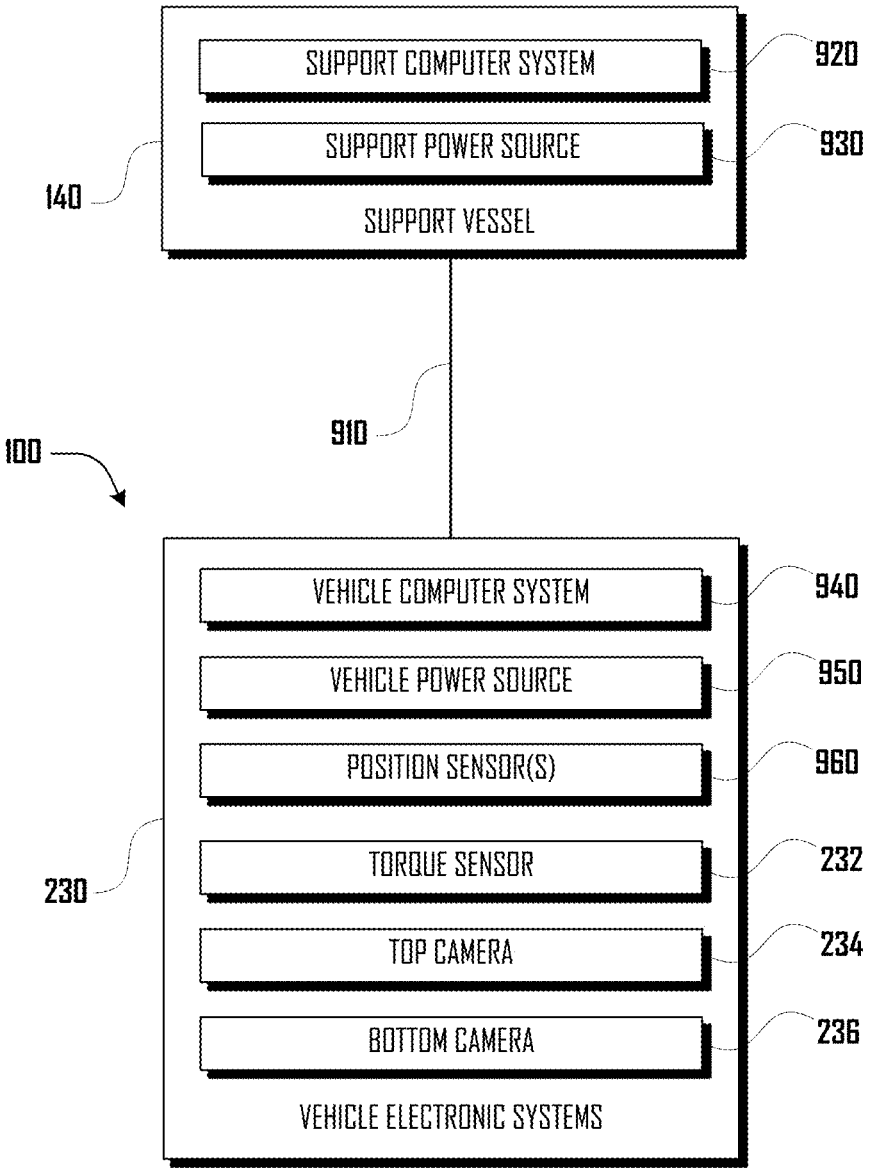
FIG. 9 is a block diagram of a support vessel and electronic systems of the vehicle that are operably connected via a network connection in accordance with one embodiment.

Turning to FIG. 9, a block diagram of a support vessel 140 and electronic systems 230 of the vehicle 100 are illustrated, where the support vessel 140 and electronic systems 230 are operably connected via a network connection 910, which can comprise a tether 130, wireless connection, or the like, as discussed herein. In this example, the support vessel 140 is shown comprising a support computer system 920 and a support power source 930. The electronic systems 230 of the vehicle 100 are shown comprising a vehicle computing system 940, a vehicle power source 950, one or more position sensors 960, a torque sensor 232, a top camera 234, and a bottom camera 236.

In various embodiments, the support computing system 920 can comprise any suitable device, including a laptop computer, desktop computer, tablet computer, smartphone, embedded system, or the like. The support power source 930 can comprise various suitable power sources 930, including a battery, solar array, generator, ship engine, electrical grid, and the like. As discussed herein, in some examples, the support vessel 140 can be configured to provide power from such a support power source 930 to the vehicle 100, which can be used to charge a vehicle power source 950 and/or power various systems of the vehicle 100.

For embodiments of a vehicle comprising electrically-actuated thrusters, an optimized power system can be designed in some examples. Because anchor installation can be a periodic activity requiring bursts of high-power anchor installation interspersed with long periods of transit and setup, various embodiments include a vehicle 100 with energy storage on the vehicle (e.g., a battery). It can be undesirable in some examples, from a cost and weight perspective, to provide the vehicle 100 with enough battery capacity for multiple anchor installations. In various embodiments, the vehicle 100 be fed power through umbilical cables such as the tether 130.

Since some examples of the vehicle 100 can be designed for non-constant high output work, it can be possible to reduce the requirements on power transmission capability of the tether 130. For example, in some embodiments, the tether 130 can be built to support an average power requirement of the vehicle 100. The vehicle 100 can have a battery system which has sufficient capacity to install one or more anchors 110. Energy can then be continuously provided by the tether 130, for example, to recharge the vehicle power source 950 at the rate of average use over a work day. Each anchoring event in some examples can draw energy from the vehicle power source 950 at a rate higher than the tether can provide. Recharging can occur during the intervals between anchoring events in various examples. This can allow for embodiments having a much smaller tether 130 than would be required to supply the peak power requirements of the vehicle 100. Similar approaches can be implemented with hydraulic or pneumatic systems.

In various embodiments, the vehicle computing system 940 can comprise any suitable device, including a laptop computer, desktop computer, tablet computer, smartphone, embedded system, or the like. The vehicle computing system 940 and support computing system 920 can comprise one or more processor and memory, which can store instructions (e.g., software), that when executed by the one or more processor, can cause the vehicle 100 and/or support vessel 140 to perform various methods described herein, including methods in installing anchors 110, uninstalling anchors 110, and the like.

The one or more position sensors 960 can comprise various suitable types of sensors, including a global positioning system (GPS), magnetometer, gyroscope, and the like. The top camera 234 and bottom camera 236 can include various suitable types of cameras configured to capture images of light at various suitable wavelengths, including visible light spectrum, ultraviolet, infrared, and the like. While various examples illustrate a top camera 234 and bottom camera 236 on a top and bottom of the frame 205 of the vehicle, one or more cameras can be located in various other suitable locations in any suitable number. Also, various embodiments can include any suitable imaging systems aside from or in addition to cameras, such as LIDAR, SONAR, and the like. In various embodiments, the vehicle 100 can comprise an imaging system which stabilizes an operator's view while the vehicle 100 is rotationally installing an anchor 110. This may take the form of a physically moving camera mount, a video processing script that counteracts the rotational motion of the vehicle 100 such that a video image remains rotationally still during the operation or recording, and the like. It should be clear that further embodiments can comprise various suitable sensors, imaging devices, positioning devices, and the like, so the examples described herein should not be construed to be limiting.

For example, in some embodiments the vehicle 100 can act as a Remotely Operated Vehicle (ROV) that is controlled completely, substantially or at least in part by a human operator and/or support computer system 920. In one example, a human operator can receive data from the vehicle 100 via the network connection 910, such as data from sensors (e.g., torque and position sensors 960, 232) and imaging devices (e.g., cameras 234, 236), which can be presented to the human operator via an interface of the support computer system 920 such as a screen, or the like. The human operator can control the vehicle 100 to perform various tasks based on such presented information such as maneuvering in the water 105, coupling with an anchor 110, releasing an anchor 110, installing an anchor 110 in a substrate 115, removing an anchor from a substrate 115, and the like, which can include input to an interface such as a joystick, yoke, graphical user interface on a touch screen, or the like.

Such control by an operator via the support computer system 920 can be at various levels of control granularity in various embodiments including, initiating execution of an anchor installation plan; providing general objectives for anchor installation; initiating general actions during anchor installation; providing general instructions for anchor installation; providing specific instructions for anchor installation; controlling specific motor functions during anchor installation, and the like.

For example, in one embodiment, an operator can upload or input an anchor installation plan to the support computer system 920 and instruct the vehicle 100 to execute the anchor installation plan, which causes the vehicle 100 to execute the anchor installation plan, including automated installation of one or more anchors 110 without additional input from the operator (however, the vehicle 100 may alert the operator if errors occur that require the operator's attention).

In another example, an operator can monitor execution of an anchor installation plan and approve or initiate various steps during execution, such as loading an anchor 110; moving to an anchor installation location; beginning installation of the anchor 110; terminating installation of the anchor 110 (e.g., stopping spinning of the vehicle) releasing an installed anchor 110, returning to the support vessel 140, and the like. In such an example, in various embodiments, the vehicle can autonomously complete an approved or initiated task and stop before moving on to a further task (however, the vehicle 100 may also alert the operator if errors occur during execution of a task that require the operator's attention).

In various embodiments an operator can control the specific actions of the vehicle during one or more steps of installing an anchor 110, including driving the vehicle 100 to an anchor installation location (e.g., via a joystick using cameras and/or presented positioning data as a guide); lowering the vehicle 100 at an anchor installation location so that the head 114 of the anchor 110 engages the substrate 115; initiating and controlling rotational speed, applied torque and/or thruster power during installation of an anchor 110; disengaging from an installed anchor by actuating an anchor system 250; driving away from an installed anchor 110, and the like.

As discussed herein, the vehicle 100 can be configured to perform various actions, steps, functionalities, or the like, autonomously and without direct input from a human operator. In various embodiments, the vehicle 100 can be configured to maintain a set orientation during installation or removal of an anchor 110. For example, it can be desirable for the vehicle to maintain the central axis Y of the vehicle 100 perpendicular to the surface of a level substrate (i.e., parallel to gravity). Accordingly, the vehicle 100 can be configured to automatically change power and/or orientation of one or more thrusters (e.g., 212, 240) to maintain such a desired orientation without direct input from an operator. In various embodiments, installation angle of an anchor 110 can be set at any suitable angle relative to gravity and/or a plane of a substrate 115 in which the anchor 110 is being installed, including level, sloping, vertical or inverted substrates, and the like.

This disclosure in various aspects includes systems and methods for installing anchors in an underwater substrate 115 such as a seabed. In various embodiments, a Remotely Operated Vehicle (ROV) can be configured to maneuver under water and to also provide a large amount of rotational torque (e.g., greater than 50, 100, 1000, 10000, 100000, 1000000 Newton-meters, or the like) about a vertical axis to install a helical anchor in a seabed. This can be achieved in some examples by moving thrusters of any suitable kind and number (e.g., thrusters 212, 250, outward from an axis of rotation such as central axis Y. Placing thrusters in a configuration such that an axis of thrust of such thrusters is substantially tangential to a circle centered at the vehicle axis of rotation X can give the most torque about the vehicle central axis Y. Thrusters 212 be mounted on arms 210 extending from the main vehicle frame 205 as discussed herein to maximize torque capability. In various embodiments, increasing arm radius can directly increase available torque at the expense of rotational speed.

Anchors 110 can require some downward force to be applied during rotational installation. In some embodiments, the vehicle can use a weighted system with weight otherwise offset via tension on the tether 130 from a winch at the surface support vehicle 140, or the like. Vertical force can be applied to the vehicle 100 by one or more thruster having a substantially vertical orientation or by canting one or more torque producing thrusters downward so that when providing torque about the vertical axis Y, they also provide vertical downward forcing.

Figure 12:
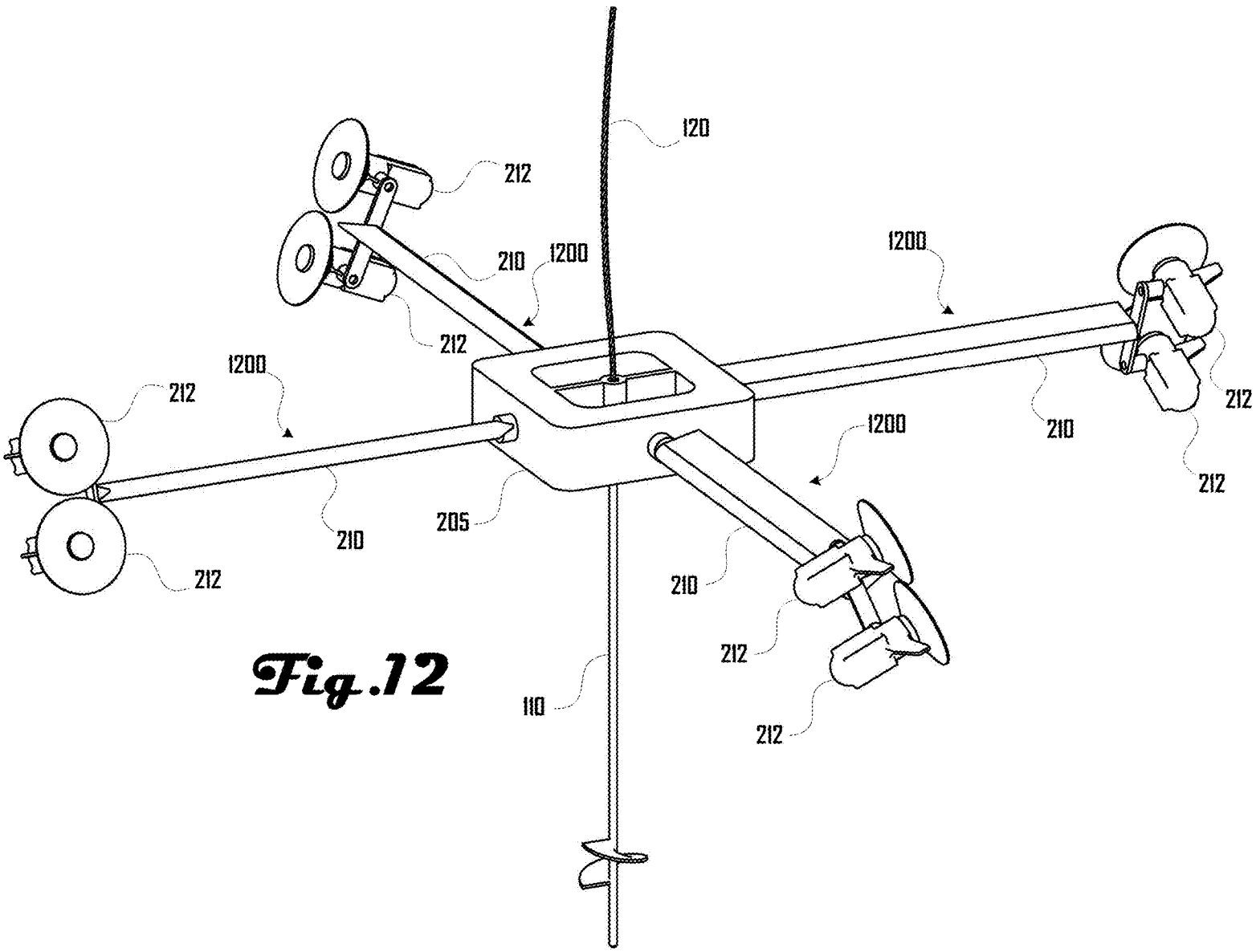
FIG. 12 is a perspective view of a vehicle in accordance with another embodiment.
Figure 13:
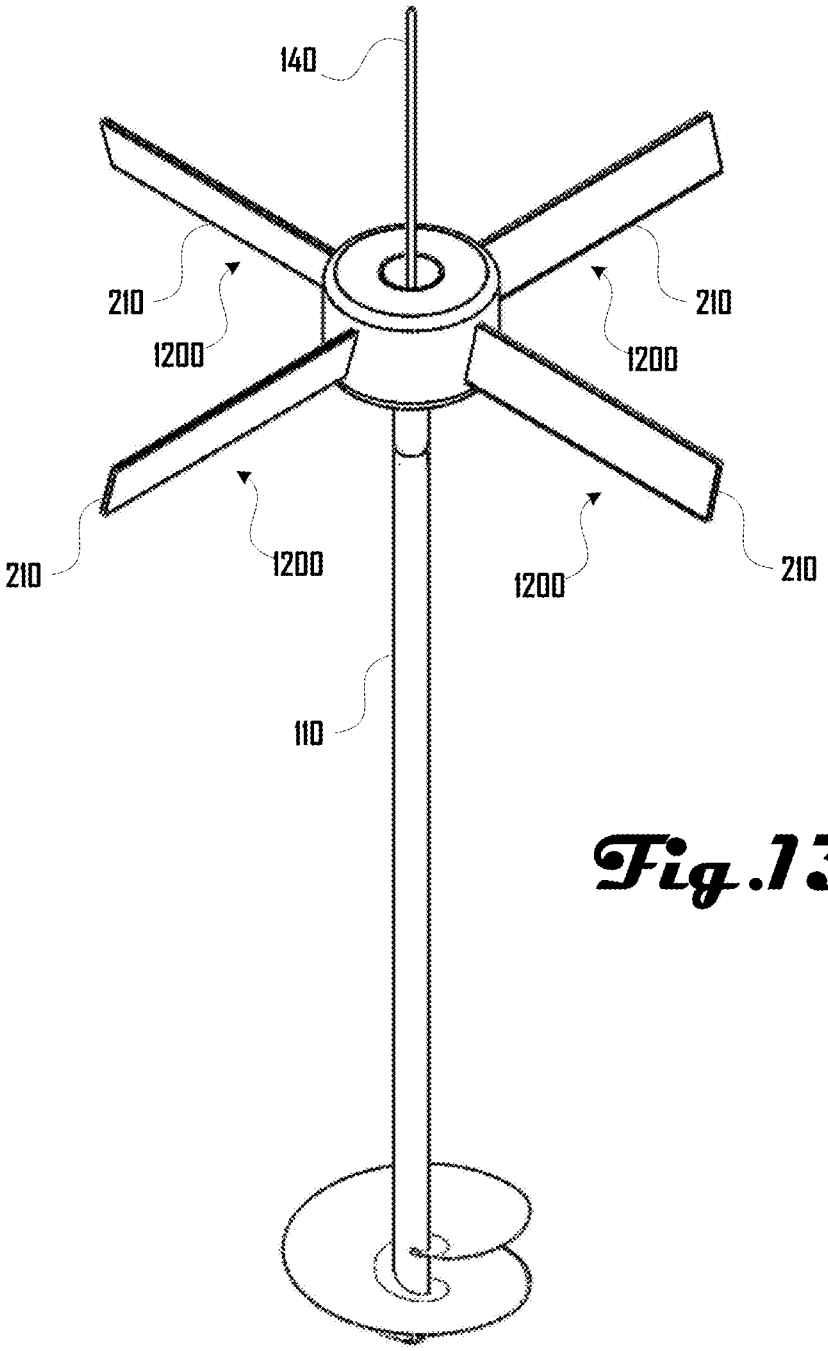
FIG. 13 is a perspective view of a vehicle in accordance with a further embodiment.

Vertical thrust can be provided in some examples by adding pitch to arms 210 that are faired 1200, such that the arms 210 shown in FIGS. 12 and 13, which can be configured to act as a large propeller. This can enable high vertical thrust in various examples (e.g., greater than 50, 100, 1000, 10000, 100000 Newtons, or the like). In some embodiments, axial thrust can be 0.1 to 5 times the weight of the anchor being installed anchor 110. In some embodiments, axial thrust can be from 0.1× to 10× the summation of direct thrust, and in some examples, such a 10× multiplier, or the like, can be achieved by pitching the arms 210 of the vehicle 100 into a large propeller configuration. In various embodiments, the orientation of one or more thrusters 212 on the arms 210 can be changed via rotation of the arms 210; however, in some embodiments, the arms 210 and thrusters 212 can be independently rotatable, which can be desirable in some examples having faired 1200 arms 210 so that force generated by orientation of the faired 1200 arms 210 can be controlled separately from the force generated by the orientation of one or more thrusters 212 on the arms 210.

In some embodiments, a light downwash can be applied by one or more thrusters or other suitable element, which can be desirable to help keep an anchoring installation zone water column clear of suspended sediment, which can aid in camera visibility and operation.

Downward force on an anchor 110 can be applied in some examples by managing buoyancy of the vehicle 100 and/or anchor 110. For instance, the vehicle may carry a buoyant element (e.g., one or more vehicle floats 1100, flotation tanks 220, or the like) with enough buoyant force to support the anchor 110 while maneuvering the anchor 110 to an installation site, then release, deflate, or flood the buoyant element to become negatively buoyant and provide a down force on the anchor 110 for installation.

In some embodiments, an anchor 110 can comprise a small tip lead-in screw, or like, to aid in initial engagement with the substrate 115 and to help the anchor 110 provide its own initial down force. A tip screw on the head 114 of an anchor 110 can be constructed to have a different pitch than one or more main helical plates (e.g., main helical plates can be larger and above the tip on the shaft 112 of the anchor 110). For example, a more aggressive pitch angle at a tip of the head 114 can be such that the screw tip can serve to pull downward on the anchor 110 relative to the main anchor plates, or a less aggressive pitch to aid in initial engagement with the seabed. Generally, significant care can be taken in some examples to match pitch in the case of multiple larger helical plates so as to minimize soil disturbance and maximize holding strength.

In various embodiments, an anchor 110 and/or vehicle 100 can be configured to better enable penetration into a substrate 115 with rock elements. For example, rock hammer drill tips and/or accommodating operation of the vehicle 100 can include hammer-drill, vibrational modes, or the like, which can be desirable for improving installation and holding strength of anchors 110 in various types of substrates 115. Some embodiments can include a cutting edge of a helical plate and can be adapted to better facilitate such drilling action, for example, a tapered lead-in or sharpened and/or serrated cutting edge that may be reinforced with specific rock cutting surfaces. In some embodiments, the vehicle 100 can be operated as a rock drill or auger, enabling predrilling for anchors and the insertion of rock anchors or the like. Rock anchoring can be accomplished beneath a sediment layer in various examples.

Figure 14C:
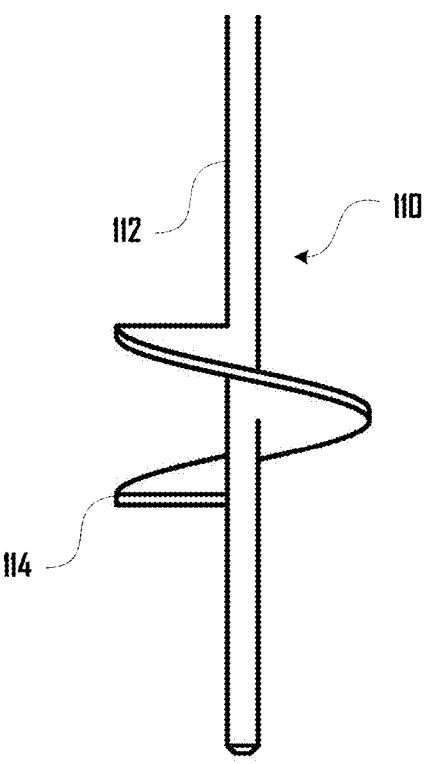
FIGS. 14*a*, 14*b* and 14*c* illustrate different embodiments of a helical anchor.
Figure 14B:
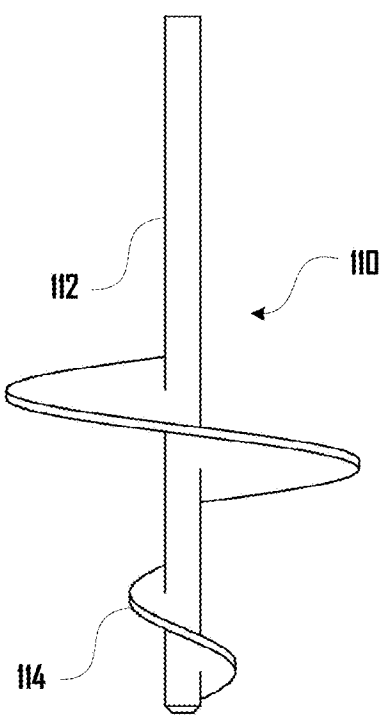
Figure 14A:
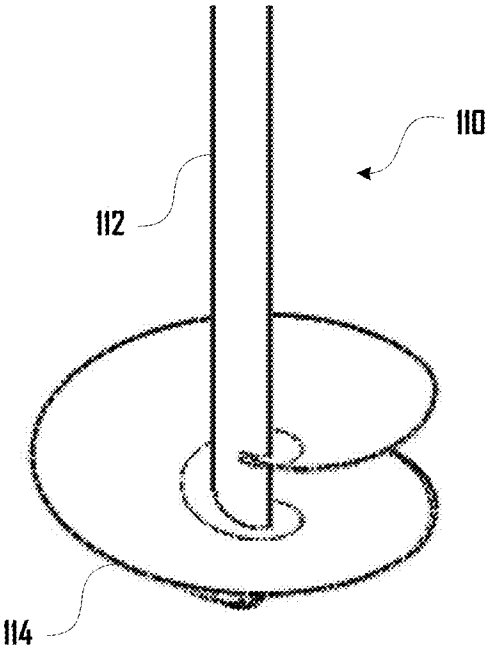
Figure 15:
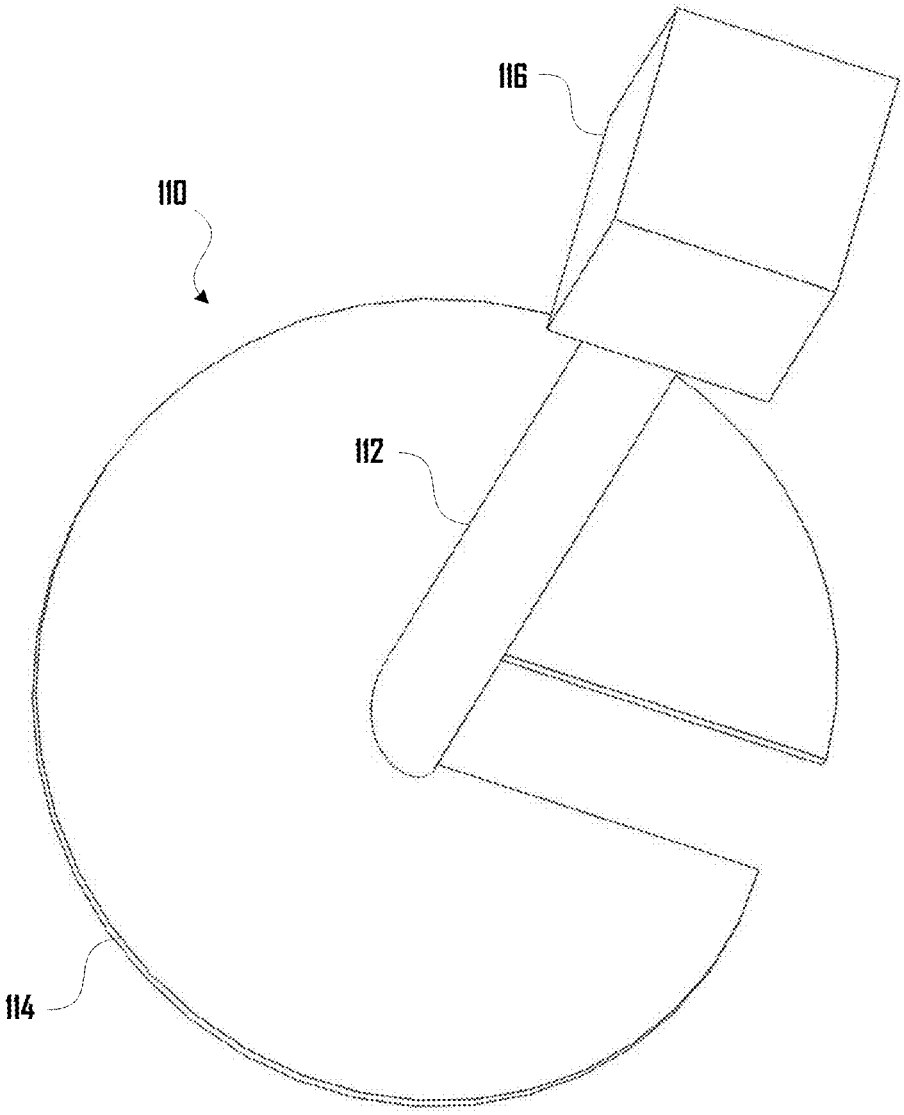
FIG. 15 illustrates a helical anchor comprising a non-circular shaft portion.
Figure 16A:
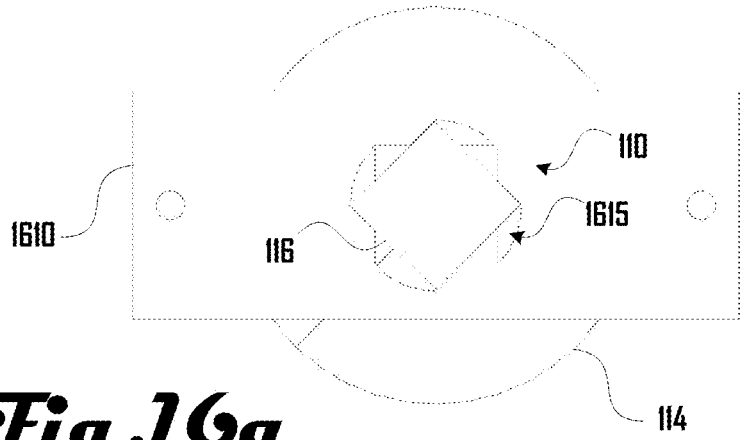
FIG. 16*a* illustrates a top view of a block comprising a non-circular hole into which a non-circular shaft portion of an anchor has been inserted in a first position.
Figure 16B:
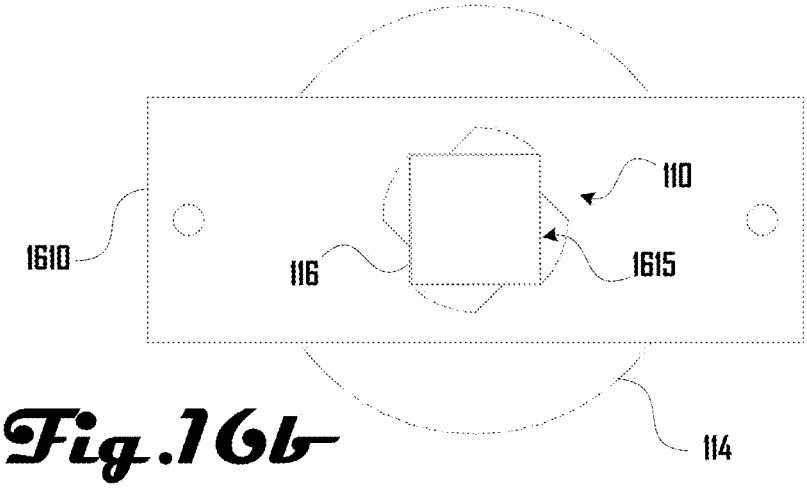
FIG. 16*b* illustrates a top view of the block and anchor of FIG. 16*b* in a second position.
Figure 16C:
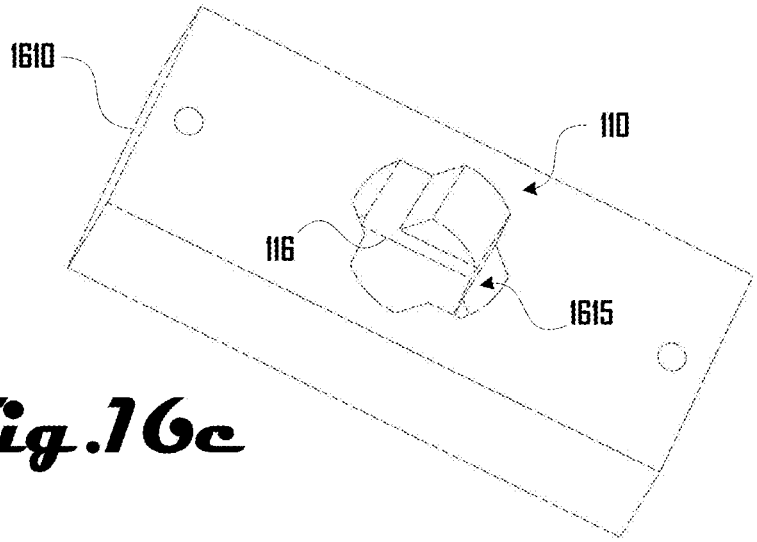
FIG. 16*c* illustrates a perspective view of a block a comprising non-circular hole into which a non-circular shaft portion of an anchor has been inserted.

In some embodiments, the vehicle 100 can be used for the direct drilling of wells, the drilling of tunnels for the passage of cables or pipelines, and so forth. The axis of drilling can depart significantly from a vertical axis of rotation (e.g., axis Y) and some examples can include flexible shafts that can transmit torque to the drilling shaft that may not be straight. Accordingly, various suitable types and configurations of anchors 110 can be used in various embodiments and the examples of anchors 110 herein, including the anchor heads 114 shown in FIGS. 14*a*, 14*b* and 14*c* should not be construed as being limiting.

In some embodiments, anchors 110 can include dished helical plates for reduced bending stress, multiple turn helical plates for distributing load over multiple turns, construction that allows for deflection, plates with sharpened and/or sawtooth edges to help cut through rock and mixed sediments and hard sediments, specialist anchor tips to improve starting performance and traction, especially in more challenging substrates, and so forth.

Anchors 110 with a central shaft 112 and head 114 comprising helical plates can be constructed with the plates forming a flat helical geometry. The loading of the plate can then be substantially in bending. The loading of the joint of the plate to the shaft can be loaded in bending and shear. In some embodiments, this can require a relatively thick plate for the load it supports. Changing the geometry of the helical plate to include a conical dish shape can allow the stresses in the helical plate to be redirected. A dished helical plate can experience lower bending loads, and can instead have a circumferential tension load, with multiple helical rotations, which are perhaps thinner and allow for some deflection, can aid this in some examples. There can also be a reduced bending moment at the interface with the central shaft 112, leaving only the shear loading in some examples. This can allow for a thinner plate to support equivalent anchoring loads, which can provide an overall lighter system and can reduce cost of manufacture and deployment.

While some examples include an anchor 110 with a unitary shaft 112, some embodiments can include an anchor system comprising a plurality of shafts 112 that can be used to drive an anchor 110 further into a substrate 115. For example, an anchor with a first shaft 112 can be driven into the substrate 115 proximate to an end of the first shaft 112 and a second shaft 112 can be coupled to the end of the first shaft. The vehicle 100 can couple with the second shaft and further drive the first shaft into the substrate 115 via the second shaft 112. Further shafts 112 can be added as necessary to further drive the first anchor into the substrate.

While various embodiments discussed herein relate to rotary installation of anchors 110 in a substrate 115 in a body of water 105, further embodiments can include various other rotary applications related to substrates 115 in a body of water 105, such as drilling, obtaining core samples, geo testing, calibrated anchor testing, and the like. For example, in some embodiments, the vehicle 100 can use a drill bit to drill a hole in a substrate 115 (e.g., coupled in the anchor system 250) and then load and install an anchor 110 in the generated hole. In further embodiments, a calibrated test anchor or test bit can be rotatably driven into a substrate, which can be used to identity type(s) of substrate 115 present, holding strength of various types of anchors 110 that may be installed in the substrate 115, and the like. In some examples, an area of a seabed can be mapped via a plurality of test anchor installations or test drilling.

Additionally, anchors 110 can be any suitable, weight, size and/or shape in various embodiments and a shaft 112 in some embodiments can have a diameter on the order or inches, feet or meters. For example, some embodiments of a vehicle can be configured to handle anchors having a shaft diameter of 0.5 to 2 inches, 2-4 inches, 6-12 inches, 1-4 feet, 1-2 meters, 4-10 meters, and the like. For example, on embodiment can include an anchor 110 having a 1-inch shaft 112 with 10-inch diameter helical plates on a head 114 of the anchor 110. Another example can include an anchor 110 having a 0.5-meter shaft 112 with 5-meter diameter helical plates on a head 114 of the anchor 110.

In some embodiments, the vehicle 100 can be permanently attached or remain attached to an anchor 110 while the anchor 110 is installed in a substrate. Such a configuration can create a mobile anchoring solution that can overcome some of the limitations of traditional drag embedment anchors. For example, a ship can release a vehicle 100, which can install and remain coupled with an anchor 110 in a substrate 115. The anchor 110 and vehicle 100 can provide temporary anchoring or mooring for the ship and when the ship needs to move from the location, the vehicle 100 can uninstall the anchor 110 from the substrate 115 and return to the ship so that the ship can move away.

In some embodiments, such anchoring can be automated in various ways. For example, an operator on a support vessel 140 can deploy the vehicle 100 and simply instruct the vehicle to anchor within certain parameters (e.g., within a certain radius of the vessel, within a defined area, with at least a defined anchor strength, within a certain depth range, with a tether length within a certain range, or the like), and the vehicle 100 can automatically generate an anchor the support vessel 140, which in some examples can include testing for suitable anchoring locations, and the like. In further embodiments, an operator can control the vehicle 100 as discussed herein at various levels of granularity in the process of generating an anchor for the support vessel 140.

In some examples, multiple vehicles 100 can be used to generate an anchor array which may increase the speed and precision of anchoring and may reduce the impact of multi-point anchoring, which can be desirable in some examples for temporary applications where anchoring might be frequent, and speed of anchoring might be desirable. Multiple anchors 110 can be installed and removed concurrently in some examples.

In order to reduce the amount of force or torque required to insert an anchor 110 into a substrate 115, in some embodiments, the anchor 110 can be constructed so that a fluid can be pumped out of or into a surface of the anchor 110. This fluid may function to erode or loosen sediment in front of a leading edge of the anchor 110 or to displace sediment or other material from contacting or causing friction with surfaces of the anchor 110. Some embodiments can have a tube capable of carrying fluid along the structure of an anchor 110 and along the leading edge and/or other surface of the anchor 110. The tube may have a plurality of orifices through which to discharge or intake a fluid can occur. In some embodiments, there can be a pump that forces water or other fluid through a tube or other cavity into the anchor 110 and forces the water out through one or more orifice, slot, or other opening on the surface of an anchor 110. Such a pump may be located on a support vessel 140 and/or on the vehicle 100. A coupling from the vehicle 100 to an anchor 110 (e.g., an anchor system 250) can include a provision to allow pumped fluid to pass from the vehicle 100 to the anchor. A coupling from vehicle 100 to an anchor 110 may have a disconnectable fluid coupler.

Orifices used to direct a fluid out of a surface of an anchor 110 (e.g., shaft 112, head 114, or the like) may be configured to cause high velocity discharge of the fluid. Orifices may be configured to cause material in front of the orifice to be preferentially moved in a selected direction such as radially inward or outward from an anchor axis Y. Orifices may be configured to create a cavity in the sediment in front of the leading edge of the anchor which can preferentially allow the anchor to move downward into the sediment.

There may also be a pumping system which can take in fluid from some surfaces of an anchor 110 while discharging fluid from other surfaces. Fluid may be taken up so that a volume of recovered fluid and eroded substrate 115 offsets the volume of discharged fluid, allowing an anchor 110 to pass through substrate 115 without substantially displacing substrate 115 that is not in the path of the anchor 110 moving through it.

In some embodiments, the vehicle 100 can include an attachment or location where one or more anchors 110 can be stored. Such an attachment or location can be configured to hold the one or more anchors 110, which can then be loaded in the anchor system 250 for installation. Similarly, one or more anchors 110 that are removed from a substrate 115 can be stored on or about the vehicle 100. In some embodiments, the vehicle 100 can be configured to store one or more anchors 110, which can be automatically loaded and/or unloaded from the anchor system 250. Such embodiments can be desirable for allowing the vehicle 100 to install a plurality of anchors 110 at a time without having to obtain additional anchors 110 (e.g., from a support vessel 140) and/or to collect a plurality of anchors 110 at a time without having to offload anchors 110 one at a time (e.g., to a support vessel 140).

Accordingly, an anchor installation method of one embodiment includes automated loading of a first anchor 110 into an anchor system 250 from an anchor supply of a plurality of anchors 110 disposed on or about the vehicle 100; installing and releasing the first anchor 110; automated loading of a second anchor 110 into the anchor system 250 from anchor supply; and installing and releasing the second anchor 110. An anchor removal method of one embodiment can include engaging with and removing a first anchor 110 from a substrate 115; automatically removing the first anchor 110 from the anchor system 250 and storing the first anchor 110 in an anchor storage location on or about the vehicle 100; engaging with and removing a second anchor 110 from the substrate 115; automatically removing the second anchor 110 from the anchor system 250 and storing the second anchor 110 in the anchor storage location on or about the vehicle 100.

Attachment of one or more anchors 110 to the vehicle 100 can be performed in water 105 away from the support vessel 140 in various embodiments. As discussed above, the vehicle 100 may have a mechanism to automatically couple to an anchor 110 to the vehicle 100. This mechanism may include a latching system in some examples. Anchors 110 may be provided with a buoyancy component which can allow an anchor 110 to be floated independently and held in an orientation which can allow the vehicle 100 to couple with the anchor 110 when both the anchor 110 and vehicle 100 are free-floating in the water 105. Anchor coupling to the vehicle 100 may be assisted by an operator, may be assisted by use of a manipulator arm mounted on the vehicle 100 or support vessel 140, or the like. Anchors 110 can be stowed on a support vessel 140 or other craft and craned to a position where the vehicle 100 can attach to such anchors 110, and in some embodiments the vehicle 100 be directly lifted above the water 105 to aid anchor attachment.

Anchoring operations may require use of multiple anchors 110 in various embodiments. Anchors 110 in some examples may take up a large amount of space relative to the available area on a support vessel 140 that stores the anchors 110. To preserve free deck space on the support vessel 140, anchors 110 may be transported in an assembled or disassembled state where the head 114 (e.g., having helical plates) and shaft 112 are not coupled. Anchors 112 may be transported in racks over the side of a vessel 140, in vertical racks or racks of other suitable orientation, on a towed barge or sled, on a separate support vessel, which in some examples can be provided with periodic anchor re-supply, and so forth.

As discussed herein, the vehicle 100 can comprise various suitable anchors 110 and anchor loading/unloading systems (e.g., an anchor system 250) that allow the vehicle 100 to engage and/or release anchors 110, which in some embodiments can be automated or may require assistance of a human operator or external loading/unloading system. An example of such a system and anchor 110 of one embodiment are shown in FIGS. 15 and 16*a-c*, which includes a block 1600 with a non-circular hole 1615 into which a non-circular shaft extension 116 (or portion of the shaft 112) can be inserted. When the anchor 110 is rotated to one position (see e.g., FIG. 16*b*), the anchor shaft extension 116 and shaft 112 can be held captive in the hole 1615 and can be vertically retained. At another rotational position (see e.g., FIGS. 16*a* and 16*b*, the shaft extension 116 and shaft 112 may not be vertically retained and can be released. Mechanical latching of some embodiments can include but is not limited to independently mechanically actuated systems, permanent and electromagnetic systems, load triggered systems, and so forth.

In some embodiments, one or more anchor lines 120, or the like can be attached to anchors 110 prior to installation. Rotating an anchor 110 to install it with an anchor line 120 attached can cause undesirable twist of the one or more anchor lines 120 in some examples. Accordingly, in some examples, the vehicle 100 can be configured such that an anchor line 120 can pass through the vehicle 100 (see e.g., FIG. 12), closely around the vehicle 100, or the like. In various examples, such one or more anchor lines 120 can then be tended from the surface of the water 105 to count and counteract rotation during anchor installation or the like. Anchor lines 120 may be attached to an anchor 110 with a swivel in some examples so that the anchor 110 may be rotated without imparting twist to the anchor line 120.

By passing multiple anchor lines 120 through separating fairleads on the vehicle 100 in some examples, withdrawing the vehicle 100 to the surface after anchor release can serve to untwist multiple anchor lines 120 in some examples, given that vehicle 100 relative azimuth can be known. In some embodiments, the vehicle 100 can carry one or more anchor lines 120 on a spool attached to the vehicle 100. After an anchor 110 is installed, the anchor line spool can pay out line as the vehicle 100 drives away from the anchor 110. This can result in no relative twist between the anchor 110 and anchor line 120.

In some embodiments it can be desirable to have an anchor 110 with a short axial shaft 112 or no axial shaft 112. One or more helical plate or plates of an anchor head 114 can be embedded to a sufficient depth in the substrate 115 to generate a sufficient holding force. One or more anchor lines 120 then can extend from an attachment point on the head 114 or short shaft 120 of the anchor 110 toward or up to and through the top of the substrate 115. In some embodiments, the vehicle 100 can carry a structural extension which can allow it to embed such a short-shaft or no-shaft anchor 110 and then release such an anchor 110 within the substrate. Such structural extension can, in some examples, comprise a tube through which one or more anchor lines 120 can pass. Such extension can, in various embodiments, have a locking and release mechanism to disengage from the anchor 110. Such an extension may be smooth and/or tapered to allow for low-friction removal from the substrate 115 as the vehicle 100 pulls the extension upward out of the substrate 115 after releasing the extension from the anchor 110. A helical ridge, plate, or like, can also be incorporated into such a tube in some embodiments to better facilitate withdrawal via the vehicle 100.

In some embodiments, anchors 110 can carry multiple anchor lines 120 from a single anchor 110. Anchor lines 120, anchor line pigtails, or the like may (and in some cases must) be installed on anchors 110 before anchor embedment in the substrate 115. Anchor lines 120 can be managed in various embodiments to prevent twist and tangling as the anchor 110 is installed. The vehicle 100 in some examples can allow one or more anchor lines 120 to pass through the frame 205 or other portion of the vehicle 100 to prevent or reduce entanglement of the anchor lines 120. The vehicle 100, in various embodiments, can carry spools or other storage devices that hold one or more anchor lines 120. In some examples where the vehicle 100 detaches from the installed anchor 110, the vehicle 100 can spool out these anchor lines 120 without twisting them.

While various embodiments can include spools or other storage devices that hold one or more anchor lines 120, further embodiments can include a spool of contiguous line from which one or more anchor lines 120 can be generated. For example, some embodiments of a vehicle 100 can be configured to cut line on a spool and couple the cut line to an anchor 110 (before, after or during installation of the anchor 110) to generate one or more anchor lines 120 coupled to the anchor. Such a coupling can include knots, crimp fitting, or other suitable hardware. Anchor lines can be made of various suitable materials including a metal cable, rope, polymer line, chain, webbing, strap, tube, or the like.

In some examples, the vehicle 100 can carry lines smaller than final anchor lines 120 and bring those smaller lines (e.g., messenger lines) to the surface of the water 105 following installation of one or more anchors 110. There may be a device on, or configuration of, the anchor 110 or an anchor line pigtail which can allow for a full-sized anchor line 120 to be pulled down to the anchor 110 or pigtail and coupled to or looped through the anchor 110 or pigtail after installation.

In some instantiations the anchor 110 onto which the vehicle 100 attaches can have multiple shafts 112 and/or anchor lines 120 that conform to an outer shape (e.g., circular, square, or the like) such that upon release by the vehicle 100 and loading multiple anchor lines, individual shafts 112 are free to bend in the desired load direction, which can reduce bending moments and fatigue loadings in the associated anchor shafts 112.

With a limited amount of torque available from the thrusters 212 in various examples, it can be helpful in some embodiments to have additional torque capability available to rotatably drive anchors 110 into a substrate 115. Additional torque beyond the torque developed by thrusters 212 accelerating water 105 tangentially to the rotation axis Y can be gained by using rotational inertia in various example. The vehicle 100 or a rotationally coupled component of the vehicle 100 (e.g., a flywheel) can be used to impart a torque spike to the anchor 110. An example behavior is for the vehicle 100 to rotate the anchor 110 (e.g., in a driving rotational direction about rotational axis Y) until rising torque resistance of the anchor balances or begins to balance the thrust capability of the vehicle 100. The vehicle 100 can then rotate backwards by a small amount (i.e., the opposite direction of the driving rotational direction about rotational axis Y), using rotational free play in an anchor connection, allowing the anchor 110 to remain in position. The vehicle 100 can then rapidly rotate forward (e.g., again in the driving rotational direction about rotational axis Y) until the rotational coupling with the anchor 110 engages. The rotational inertia of the vehicle 100 can provide a torque spike to the anchor 110 as the vehicle is rapidly decelerated by locking rotationally to the anchor 110.

For example, a method of installing an anchor 110 can comprise engaging the anchor 110 with the substrate and rotating the vehicle 100 about the central axis Y via one or more thrusters 212 disposed at the ends of one or more arms 210 to generate rotation of anchor 110 and driving of the anchor 110 into the substrate (e.g., via threads on the head 114 of the anchor and/or downward force on the anchor 110); obtaining data corresponding to rotation rate about the central axis Y (e.g., from the torque sensor 232, an accelerometer, visual data, or the like) and when the rotation rate of the vehicle 100 about the central axis Y is determined to be below a certain threshold, the vehicle 100 can reverse rotation direction about the central axis Y (e.g., by reversing spin of propellers of the thrusters 212, reversing orientation of the thrusters 212, actuating reverse thrusters, or the like).

In various examples, reversing the rotation direction of the vehicle 100 about the central axis Y can cause the anchor 110 to similarly rotate in the opposite direction or reversing the rotation direction of the vehicle 100 about the central axis Y can occur without or substantially without the anchor 110 rotating in the opposite direction. For example, a coupling between the anchor 110 and vehicle 100 can be unidirectional (e.g., via a ratchet), can be capable of some amount of reverse without or substantially without rotating the anchor 110 in the opposite direction, or the like.

The vehicle 100 can then rapidly rotate forward in the driving rotational direction about rotational axis Y until the rotational coupling with the anchor 110 engages and generates a torque spike to the anchor 110. In various embodiments, such a torque spike can be generated a plurality of times. For example, in some embodiments, the vehicle 100 can determine the amount of driving or rotation of the anchor 110 generated by a given torque spike (e.g., via data from the torque sensor 232, an accelerometer, visual data, or the like) and if such driving or rotation is below a threshold, then the vehicle can determine that the anchor 110 has been driven a maximum amount and can disengage from the installed anchor 110.

In some embodiments, where the amount of driving or rotation of the anchor 110 generated by a given torque spike is determined to be above a threshold or where data otherwise meets certain criteria, the vehicle 100 can determine to return to maintained rotation of the vehicle 100 to drive the anchor 110. For example, torque spiking can cause the anchor 110 to move past a rock or break up a hard portion of the substrate 115, which may have been inhibiting installation of the anchor 110 via maintained rotation of the vehicle 100 in the driving direction about the central axis Y.

In some embodiments a transition between torque spiking and rotational operation can be achieved using a torque-limiting clutch configuration (e.g., similar to a handheld impact wrench type tool). In some embodiments, the anchor system 250 can include a slip-and-catch clutch device, an actuatable clutch or brake, rotary hammer components, or the like, which can allow 100 the vehicle to impart torque spikes to the anchor 110 that in some examples can exceed a continuous torque capability of the vehicle 100. Such torque spikes can be achieved without reversal of the rotational direction of the vehicle 100 in some embodiments. Such torque spikes can occur periodically through kinematic constraints of motions, under manual, under programmed control, or the like. Torque spikes can occur in some examples resulting from momentary coupling of the rotational inertia of the rotating vehicle 100 to an anchor 110 that is rotating more slowly or is stationary.

In various embodiments, an impact driver mechanism of the anchor system 250 can act as a pulsed gearing system, which can enable a relatively small vehicle 100 to install much larger anchors 110, which can reduce the size, mass and cost of the vehicle 100 and can increase convenience in various examples. For example, in various embodiments, an impact driver can allow the vehicle 100 to continue rotating at full thrust to generate greater than average torque.

For example, an impact driver system can automatically sense when additional torque is desirable and can create rotational impact force with a spring, rotational hammer and rotational anvil. As a motor turns a shaft with a rotary hammer, a spring can compress and then release forcefully, which can drive the rotary hammer against a rotary anvil. This action can happen rapidly (e.g., more than 50 times every second) and can creates a much larger force than a constant rotational system. For example, each half turn of the vehicle 100 can rotate a hammer that compresses a spring. When that spring is released, the energy can drive the hammer down on the anvil, simultaneously twisting the anvil, which in turn twists the anchor 110. Such a concussive force can distinguish an impact driver from a standard rotary driver which may require application of downward force on an anchor 110 during driving of the anchor 110. In some examples, an impact driver mechanism can be bidirectional, working in both directions to also enable high torque pulses for both anchor removal and installation.

While anchors 110 can be driven in some examples until the vehicle 100 is unable to rotate the anchor 110 any further or until a maximum torque, rotation rate or resistance threshold is reached, in further examples, anchors 110 can be driven to a specific desired depth, such as a maximum depth, minimum depth, or the like. Such embodiments can be desirable where uniformity of anchor shaft length extending from a substrate 115 is desirable; to prevent the vehicle from hitting a substrate 115 or other object by driving anchors too deep; to prevent an amount of contact with debris generated by driving and anchor 110, and the like.

In some examples, the length of an anchor 110 mounted to the vehicle 100 can be known by using various frames of reference to determine the length of the anchor 110 that has been driven into the substrate 115 and/or the length of the anchor 110 extending from the substrate. For example, various suitable indications can be used, including one or more of a determination of the distance between the vehicle and substrate 115 (e.g., visual, SONAR, LIDAR, and the like); number of rotations of the vehicle 100 during installation; torque during installation; change in depth of the vehicle during installation; contact with physical stop or guide of the vehicle; visual inspection of markings on the shaft 112, or the like.

In some examples, anchors 110 can be driven to a minimum or maximum determined holding strength. For example, holding strength of an anchor 110 can be determined based on torque during installation; depth of the anchor 110; type and configuration of anchor 110; composition or type of substrate, whether the vehicle 100 was unable to drive the anchor 110 any further; number of rotations during installation; number of torque spikes performed; and the like. Similarly, in some embodiments, the vehicle 100 can perform a test on an installed anchor 110, such as attempting to pull it from the substrate (e.g., via downward thrusters 240, or the like), moving the anchor 110 from side to side (e.g., off central axis Y), applying a vibration to the anchor 110, and the like. Movement of the anchor 110 past a given threshold, for example can cause the anchor 110 to fail the installation test.

In various embodiments, a determination can be made to terminate, complete or abort installation based on one or more of such criteria being met and/or not met. For example, an anchor installation can be determined to be complete and successful when the holding strength reached a certain threshold and when the anchor 110 has been driven into the substrate at least a minimum amount. Similarly, a determination can be made that an attempted anchor installation has failed based on one or more of such criteria being met and/or not met. For example, where an anchor 110 has been driven to a maximum depth threshold and the holding strength has not reached a minimum threshold, a determination can be made that the anchor installation has failed, and the installation process can be aborted, the anchor 110 can be uninstalled (e.g., by pulling or rotating the anchor out of the substrate 115), the anchor 110 can be abandoned, or the like.

As discussed herein, in various embodiments such determination can be made automatically without human interaction by the vehicle 100. For example, where an anchor installation is determined by the vehicle 100 to be complete, it can disengage from the installed anchor 110 and proceed to install another anchor 110, return to a designated location, provide an alert to an operator, or the like. Where an anchor installation is determined to have failed or be incomplete, the vehicle 100 can continue to attempt to install the anchor 110; take remedial action (e.g., perform a toque spike); abort the installation; send an alert to an operator; remove the anchor 110 from the substrate; attempt to install the anchor 110 in another location, replace with a smaller or larger anchor, or the like.

In some embodiments, torque generated during anchor installation can be used as a proxy for or to determine an anchor holding strength. In various examples, anchors can be adapted during the installation process, for example, by bolting on larger helical plates, until a desired installation torque is generated, and thereby a desired holding force is achieved. This can substantially reduce the need for detailed and often expensive substrate analysis in various examples. Torque generated by the vehicle 100 can be continually monitored during installation of an anchor 110, in some embodiments. For example, torque generated by the vehicle 100 can be determined by one or more of: monitoring thruster power use and thereby determining thrust generated; direct thrust measurement; direct torque measurement systems, and the like. Various suitable instrumentation systems can be used to better facilitate anchor placement monitoring, for example, camera, sonar systems and the like.

Figure 17:
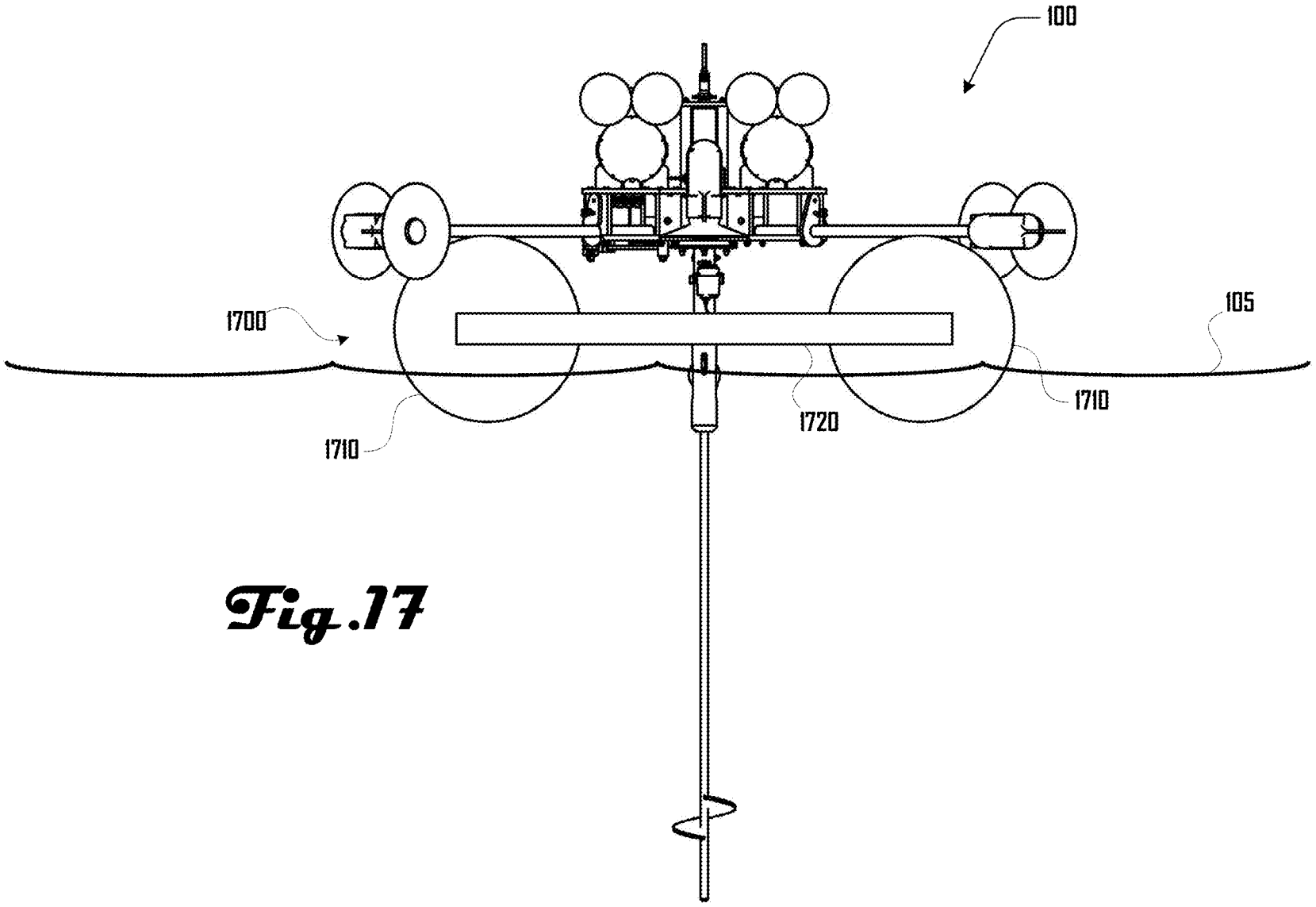
FIG. 17 illustrates a side view of a floating sled carrying a vehicle on a body of water.
Figure 18:
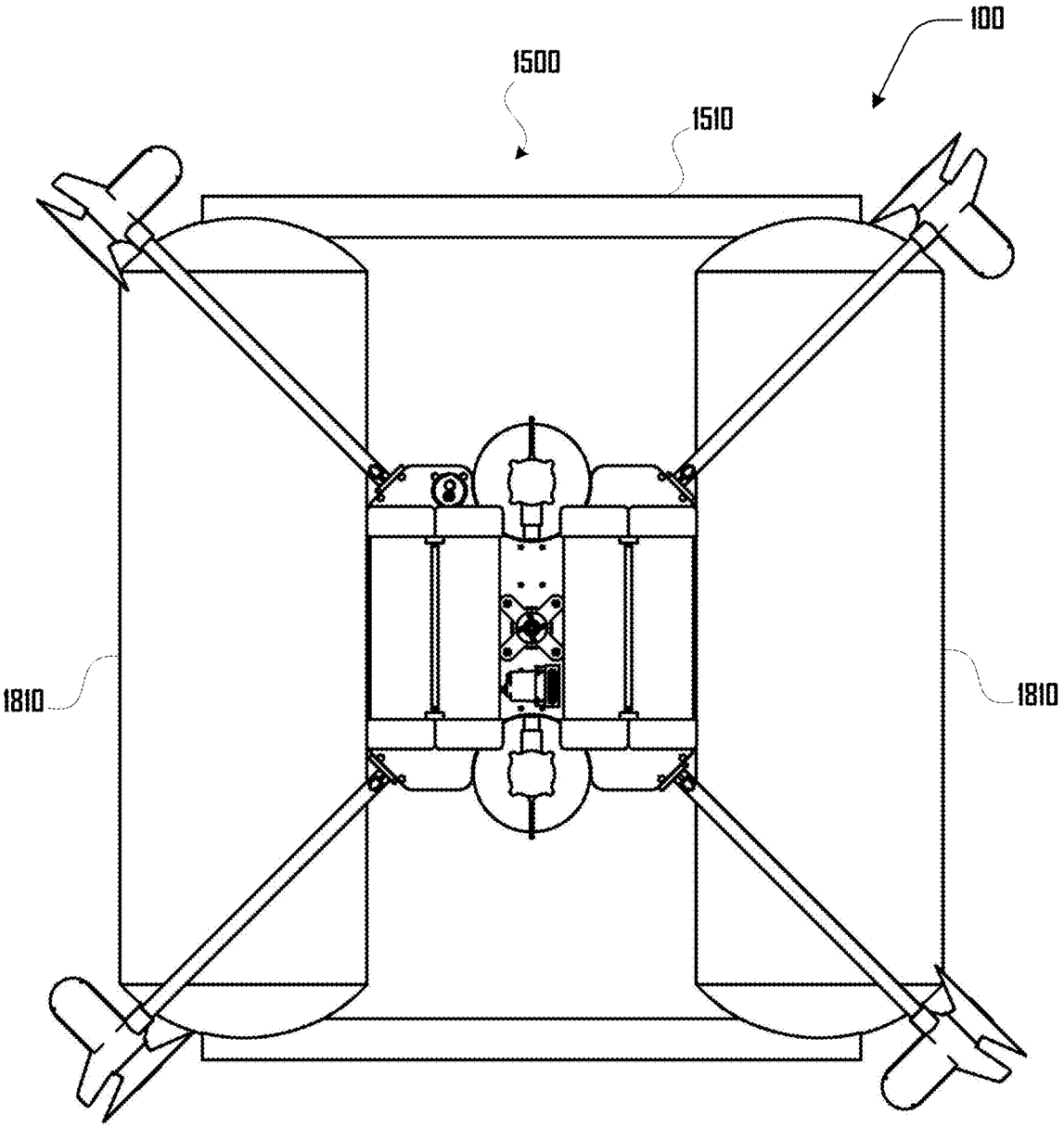
FIG. 18 illustrates a top view of the floating sled of FIG. 17 carrying the vehicle.

In some embodiments, such as shown in FIGS. 17 and 18, the vehicle 100 can be designed to comprise or connect to a sled 1700 that can be towed by the support vessel 140, or the like. The sled 1700 can include a plurality of sled floats 1721 supported by a frame 1710. In various examples, the sled 1700 can have a tow point and can have fared surfaces that fit the vehicle 100 to reduce hydrodynamic drag from the vehicle 100 when moved horizontally through the water 105. The sled 1700 can have sufficient buoyancy to lift the vehicle 100 partially or fully out of the water during transportation as shown in FIG. 17 where the frame 205, arms 210, thrusters 212, and the like are shown floating over the water 205. In some embodiments, one or more sled floats 1710 can be deflated to lower or slide the vehicle 100 into the water 105. For example, one of a pair of floats 1710 can deflate, which can allow the vehicle 100 to slide into the water 105. Similarly, the vehicle 100 can be loaded onto the sled 1700 and then one or more floats 1710 can be inflated to lift the vehicle 100 out of the water for towing.

In some examples, the vehicle 100 can be configured to be automatically deployed or return to the sled 1700, including an operator providing an instruction for "deploy" or "return"; a user initiating an anchor installation plan and the vehicle 100 automatically deploying, installing one or more anchors 110 and then returning to the sled 1700. However, in some examples, an operator can guide the vehicle 100 when being deployed and returning to the sled 1700 either via controls or physically (e.g., via a crane, winch, rope, or the like).

In some embodiments, the sled 1700 can be primarily used for storage and/or transportation of the vehicle 100; however, in some embodiments, the sled 1700 can be part of a method of installing and/or uninstalling anchors 110. For example, in one embodiment, one or more anchors 110 can be transported on a sled 1700 such that the vehicle 100 can obtain anchors 110 from the sled 1700 for installation, which can be automated or manual. For example, an anchor magazine can enable direct helical anchor attachment and pick up by the vehicle 100, noting that it is not necessary in various embodiments for anchors 110 to be stored vertically nor is it necessary in various embodiments that the vehicle 100 always maintain a vertical orientation.

Additionally, in some embodiments, a tether 130 and/or network connection 910 can be between the vehicle 100 and sled 1700. For example, a tether 130 can extend from a support vessel 140, to the sled 1700, and to the vehicle 100 or the sled 1700 can operate as a support vessel 140. In one embodiment, there can be a wireless connection between the sled 1700 and support vehicle 140, with a wired and/or wireless connection between the (e.g., comprising a tether 130 and/or network connection 910). In some examples, the sled 1700 can be configured to provide the vehicle with power, air, positioning data, control data, and the like. Accordingly, while some embodiments can include a simple mechanical sled 1700, further embodiments can include a more complex sled 1700 having a computer system, power supply, air tanks, and the like. Accordingly, various embodiments of a sled 1700 can include one or more elements of a vehicle 100 and/or support vessel 140, and in some embodiments, such elements can be specifically absent from the sled 1700.

Control software for the vehicle 100 can be configured to control the motion of the vehicle 100 in six axes in various examples. The focus of the control can be relative to the vehicle 100 itself or other suitable frame of reference. When installing an anchor, the vehicle 100 can experience a change of focus which can use a unique control mode in some examples. For example, when the anchor tip touches down on the target installation location, the vehicle 100 can switch to a control mode which is centered on the point at which the anchor 110 meets the substrate or a point in the substrate 115 around which the anchor 110 can be expected to pivot. In this control mode, the anchor tip can be expected to provide a lateral fixed point. The vehicle 100 in various examples can maneuver itself relative to that point on a hemispherical surface with a radius that decreases as the anchor 110 is installed into the substrate 115. The control goal can be to keep the anchor shaft 112 vertical (or at another desired target angle) by maneuvering the vehicle 100 laterally while the vehicle 100 rotates the anchor shaft 112 about central axis Y. There may also be instances where anchors 110 are deliberately installed at an angle from vertical. In such cases, the vehicle 100 can attempt to maintain the anchor shaft along a given vector of azimuth and elevation.

The vehicle 100 in some embodiments can enable highly precise and repeatable positioning of anchors. Surface GPS, underwater positioning systems, direct observation, (e.g., via cameras), and so forth, can be used to help facilitate high-precision in various embodiments.

Anchors 110 and vehicles 100 in various embodiments can scale from a holding capacity of a few kilograms to many thousands of tons. Thruster size, speed, number, arm length, and the like, can be changed to achieve desired torques and speeds. Pulsed rotational inertia methods can be used in some examples to increase the effective torque capacity of smaller vehicle 100 systems, enabling them to drive larger anchors 110.

In some instantiations, a hydraulic motor, or like, can torsionally interface between the vehicle 100 and anchor 110. For example, such a method can be used in some examples to aid in torque pulsing, and better use of vehicle 100 rotational inertia to this end.

Multiple helical anchors can be deployed in some embodiments in close proximity and in set patterns so as to achieve group anchoring functions, such as the anchoring of larger rigid structures with multiple anchoring points, branching mooring lines where multiple smaller anchors connect to a larger mooring line which can provide redundancy and can reduce the maximum anchor size and depth, multiple anchor swing mooring configurations, and so forth. High precision anchoring of various embodiments can enable anchoring systems not traditionally used, for example, anchors 110 might be installed precisely within ground plates that include hole patterns for the insertion of anchors 110. An analogy might be that the vehicle 100 in some examples can enable operation in a manner comparable to an electric screwdriver.

As discussed herein, possible applications of such a vehicle 100 and anchors 110 can include aquaculture, boat mooring, buoy anchoring, wind turbines, oil and gas, pipeline anchoring, science instrument anchoring, geotech core drilling, wells, tunnels, and so forth.

In various embodiments, the vehicle 100 may be manually piloted and/or autonomously controlled. For example, the vehicle 100, and/or support computing system 920 on the support vessel 140, may use dead reckoning, inertial navigation or acoustic navigation sensors to determine the position of the anchor and/or vehicle 100. The vehicle 100 may transit to a target installation location autonomously and may install the anchor 110 autonomously controlling position, orientation, torque, and the like. Navigation to the target location may be achieved using an acoustic system with fixed beacons as in a long baseline acoustic array. Navigation may be achieved relative to a surface support vessel 140 using short baseline acoustic navigation techniques. The absolute location of the vehicle 100 may be determined using a combination of GPS or other positioning technique for the surface vessel 140 and a relative position of the vehicle 100 to the surface vessel 140 determined visually, acoustically, or by other suitable methods. In some instantiations, the vehicle 100 can operate without a tether 130 or umbilical cord as discussed herein.

As discussed herein, determination of anchor embedment depth may be performed by the vehicle 100 through any combination of visual observation, sensing of depth under water by pressure or acoustic methods, by sensing distance to the substrate/water interface by optical or acoustic methods, and so forth. In some examples, anchors 110 can be directly instrumented to provide various types of data. Instrumented anchors 110 can be used in some examples to help assess and characterize the substrate 115, perform an anchor installation pre-test, or the like.

The anchoring vehicle 100 may be configured to re-attach to an anchor shaft 112 or end 116 (e.g., via the anchor system 250) and to rotate in a direction that will unscrew the anchor 110 from the substrate 115 to remove the anchor. Reattachment to an anchor 110 can be achieved with a latching mechanism in some examples, which can be engaged by maneuvering the vehicle 100 into an engagement position. The vehicle 100 may be attached to the anchor shaft 112 or end 116 in some examples with the aid of a manipulator arm mounted on the vehicle 100. In some instantiations an anchor line 120 can be used as a guide to help reattach the vehicle 100 to the anchor 110, and in some embodiments, such a coupling can occur beneath or within the substrate 115, for example with the torque shaft configured to dig down to an anchor attachment point such as the shaft 112 or end 116. In some examples, such an action can be aided by forcing a fluid such as water or air out of the torque shaft or from an opening near the torque shaft to aid in displacing sediment from the anchor attachment point.

Additionally, while various embodiments of a vehicle 100 are remotely and/or autonomously operated and are not configured to be operated by a human operator riding on or about the vehicle 100, some embodiments can be configured for direct use by a human operator. For example, some embodiments of a vehicle 100 can comprise a cabin configured for a human operator, which may or may not be environmentally controlled such that the operator can ride in the cabin without SCUBA gear, or the like. In some embodiments, a cabin for a human operator can be configured to remain stationary as a portion of the vehicle rotates to install anchors 115 as discussed herein.

The described embodiments are susceptible to various modifications and alternative forms, and specific examples thereof have been shown by way of example in the drawings and are herein described in detail. It should be understood, however, that the described embodiments are not to be limited to the particular forms or methods disclosed, but to the contrary, the present disclosure is to cover all modifications, equivalents, and alternatives. Additionally, elements of a given embodiment should not be construed to be applicable to only that example embodiment and therefore elements of one example embodiment can be applicable to other embodiments. Additionally, elements that are specifically shown in example embodiments should be construed to cover embodiments that comprise, consist essentially of, or consist of such elements, or such elements can be explicitly absent from further embodiments. Accordingly, the recitation of an element being present in one example should be construed to support some embodiments where such an element is explicitly absent.

What is claimed is:

1. An anchor installation vehicle including:

a vehicle frame having a top end and bottom end;

at least three linear arms extending outward from the vehicle frame;

one or more rotational thrusters disposed at distal ends of the respective arms;

an electronic system;

an anchor system that holds an anchor extending from the bottom end of the vehicle frame and aligned with a central axis Y that is perpendicular to the at least three linear arms;

a tether coupled at the top end of the vehicle frame and configured to communicate data with a support vessel floating on a body of water, the tether further configured to provide electrical power from the support vessel to the anchor installation vehicle; and a torque sensor operably connected to the electronic system, wherein the anchor installation vehicle is configured to be driven in the body of water via at least the rotational thrusters, based at least in part on a first set of instructions received via the tether from a support computer system of the support vessel, to an anchor installation location on an underwater substrate in the body of water;

wherein the anchor installation vehicle is configured to be rotated via the rotational thrusters about the central axis Y to drive the anchor downward into the underwater substrate at the anchor installation location; and wherein the anchor system is configured to be disengaged from the anchor to release the anchor.

2. The anchor installation vehicle of claim 1, wherein the anchor installation vehicle has exactly four arms extending from the vehicle frame.

3. The anchor installation vehicle of claim 1, wherein the tether is coupled to the anchor installation vehicle via a slip ring tether attachment that is coincident with the central axis Y.

4. The anchor installation vehicle of claim 1, wherein the anchor installation vehicle further comprises:

a bottom camera coupled at the bottom end of the vehicle frame operably connected to the electronic system.

5. The anchor installation vehicle of claim 1, wherein the anchor installation vehicle is configured to be driven, based at least in part on a second set of instructions received via the tether from the support computer system of the support vessel, to engage the anchor with the underwater substrate at the anchor installation location.

6. The anchor installation vehicle of claim 1, wherein rotating the anchor installation vehicle via the rotational thrusters about the central axis Y to drive the anchor downward into the underwater substrate at the anchor installation location includes maintaining a substantially consistent orientation of the central axis Y relative to a plane of the underwater substrate at the anchor installation location.

7. An anchor installation vehicle including:

a vehicle frame having a top end and bottom end, a plurality of arms extending outward from the vehicle frame, one or more rotational thrusters disposed at distal ends of the respective arms, and an anchor system that holds an anchor extending from the bottom end of the vehicle frame with the anchor aligned with a central axis Y.

8. The anchor installation vehicle of claim 7, wherein the anchor installation vehicle further comprises a tether coupled at the top end of the vehicle frame configured to provide a communication channel with a support vessel floating on a body of water.

9. The anchor installation vehicle of claim 7, wherein the anchor installation vehicle is configured to be driven in a body of water via at least the rotational thrusters, based at least in part on a first set of instructions received from a support computer system of a support vessel, to an anchor installation location of an underwater substrate in the body of water.

10. The anchor installation vehicle of claim 9, wherein the anchor installation vehicle is configured to generate an axial force on the anchor along central axis Y by one or more of: tether tension and weight, reducing buoyancy of the anchor installation vehicle, changing pitch of the plurality of arms, an axial thrust component, and a self-starting anchor design.

11. The anchor installation vehicle of claim 7, wherein the anchor installation vehicle is configured to determine that installation of the anchor is complete and stop rotating of the anchor installation vehicle about the central axis Y based on determining that installation of the anchor is complete.

12. The anchor installation vehicle of claim 11, wherein the anchor installation vehicle further comprises a torque sensor, and wherein the determination that installation of the anchor is complete is based at least in part on data obtained from the torque sensor.

13. The anchor installation vehicle of claim 7, wherein the anchor system is configured to disengage from the anchor to release the anchor.

14. An anchor installation vehicle including:

a vehicle frame having a top end and bottom end, one or more rotational thrusters, and an anchor system configured to hold an anchor extending from the bottom end of the vehicle frame, wherein the anchor installation vehicle is configured to operate underwater, wherein the anchor installation vehicle is configured to rotationally drive the anchor into an underwater substrate, and wherein the anchor installation vehicle is configured to rotationally drive the anchor into the underwater substrate based on rotation of the anchor installation vehicle caused by the one or more rotational thrusters.

15. The anchor installation vehicle of claim 14, wherein the anchor installation vehicle further comprises a tether configured to provide a communication channel with a support vessel.

16. The anchor installation vehicle of claim 14, wherein the anchor installation vehicle is configured to be driven in a body of water via at least the one or more rotational thrusters, based at least in part on a first set of instructions received from a support computer system of a support vessel, to an anchor installation location on an underwater substrate in the body of water.

17. The anchor installation vehicle of claim 14, wherein the anchor installation vehicle is configured to generate an axial force on the anchor along central axis Y by one or more of: tether tension and weight, reducing buoyancy of the anchor installation vehicle, changing pitch of one or more arms, an axial thrust component, and a self-starting anchor design.

* * * * *